US009574401B2

(12) United States Patent
Marchand et al.

(10) Patent No.: US 9,574,401 B2
(45) Date of Patent: Feb. 21, 2017

(54) DOWNHOLE MOTOR WITH CONCENTRIC ROTARY DRIVE SYSTEM

(71) Applicant: Greystone Technologies Pty. Ltd., Welshpool (AU)

(72) Inventors: Nicholas Ryan Marchand, Edmonton (CA); Jeffery Ronald Clausen, Houston, TX (US); Jonathan Ryan Prill, Edmonton (CA)

( * ) Notice: Subject to any disclaimer, the term of this patent is extended or adjusted under 35 U.S.C. 154(b) by 54 days.

(21) Appl. No.: 14/396,578

(22) PCT Filed: Apr. 26, 2013

(86) PCT No.: PCT/AU2013/000432
§ 371 (c)(1),
(2) Date: Oct. 23, 2014

(87) PCT Pub. No.: WO2013/159153
PCT Pub. Date: Oct. 31, 2013

(65) Prior Publication Data

US 2015/0114721 A1 Apr. 30, 2015

Related U.S. Application Data

(60) Provisional application No. 61/639,762, filed on Apr. 27, 2012.

(51) Int. Cl.
*F04C 29/12* (2006.01)
*F04C 2/352* (2006.01)
(Continued)

(52) U.S. Cl.
CPC ..... *E21B 4/02* (2013.01)

(58) Field of Classification Search
CPC ..... E21B 4/02
(Continued)

(56) References Cited

U.S. PATENT DOCUMENTS 4,772,185 A 9/1988 Hertell
5,518,379 A * 5/1996 Harris ..... E21B 4/02 166/312
(Continued)

FOREIGN PATENT DOCUMENTS

WO 92/14037 A1 8/1992

OTHER PUBLICATIONS

PCT/AU2013/000432 International Search Report and Written Opinion dated Jul. 9, 2013 (7 p.).
(Continued)

*Primary Examiner* — Kenneth Bomberg
*Assistant Examiner* — Deming Wan
(74) *Attorney, Agent, or Firm* — Conley Rose, P.C.

(57) ABSTRACT

A rotary fluid drive has first and second bodies 20, 120. The second body 120 is rotatable relative to and inside of the first body 20 defining a working fluid space 40 there between. Gates 130 are supported by the first body 20 and lobes 124 are provide on the second body 120. Gate pockets 26 are formed in the first body 20 into which the gates swing when contacted by the lobes 124. The gates 130 and the gate pockets 26 are configured to form a debris chamber 27 there between capable of temporarily accommodating solid debris. Each gate 130 has a plurality of projections 136A with intervening gaps 136B. The gaps form a gate pocket flow path 141. Working fluid flows via each gate pocket flow path 141 into the working fluid space 40 when the associated gate 130 is maximally deflected into its associated gate pocket 26.

31 Claims, 18 Drawing Sheets

(51) Int. Cl.

| | |
|---|---|
| ***F01C 1/356*** | (2006.01) |
| ***F04C 18/352*** | (2006.01) |
| ***F04C 15/06*** | (2006.01) |
| ***E21B 7/00*** | (2006.01) |
| ***E21B 4/02*** | (2006.01) |

(58) Field of Classification Search
USPC ..... 418/176, 15, 270, 224, 266–267, 246,418/262, 263; 175/107, 92
See application file for complete search history.

(56) References Cited

U.S. PATENT DOCUMENTS

| | | | |
|---|---|---|---|
| 6,280,169 | B1 | 8/2001 | Dyktynski et al. |
| 6,302,666 | B1 | 10/2001 | Grupping |
| 6,468,061 | B2 | 10/2002 | Dyktynski et al. |
| 6,939,117 | B2 | 9/2005 | Wheeler et al. |
| 6,976,832 | B1 | 12/2005 | Wheeler et al. |
| 7,523,792 | B2 | 4/2009 | El-Rayes et al. |

OTHER PUBLICATIONS

PCT/AU2013/000432 International Preliminary Report on Patentability dated Mar. 25, 2014 and Article 34 Amendments (17 p.).
PCT/US2013/038446 International Search Report and Written Opinion dated Nov. 25, 2013 ( 9 p.).

* cited by examiner

DOWNHOLE MOTOR WITH CONCENTRIC ROTARY DRIVE SYSTEM

CROSS-REFERENCE TO RELATED APPLICATIONS

This application is a 35 U.S.C. §371 national stage application of PCT/AU2013/000432 filed Apr. 26, 2013 and entitled "Downhole Motor with Concentric Rotary Drive System," which claims priority to U.S. Provisional Application No. 61/639,762 filed Apr. 27, 2012 and entitled "Downhole Motor with Concentric Rotary Drive System," both of which are hereby incorporated herein by reference in their entirety for all purposes.

STATEMENT REGARDING FEDERALLY SPONSORED RESEARCH OR DEVELOPMENT

Not applicable.

BACKGROUND

Field of the Disclosure

The present disclosure relates in general to bearing assemblies for downhole motors used in drilling of oil, gas, and water wells. The present disclosure also relates to drive systems incorporated in such downhole motors.

Background

In drilling a wellbore into the earth, such as for the recovery of hydrocarbons or minerals from a subsurface formation, it is conventional practice to connect a drill bit onto the lower end of an assembly of drill pipe sections connected end-to-end (commonly referred to as a "drill string"), and then rotate the drill string so that the drill bit progresses downward into the earth to create the desired wellbore. In conventional vertical wellbore drilling operations, the drill string and bit are rotated by means of either a "rotary table" or a "top drive" associated with a drilling rig erected at the ground surface over the wellbore (or, in offshore drilling operations, on a seabed-supported drilling platform or a suitably adapted floating vessel).

During the drilling process, a drilling fluid (also commonly referred to in the industry as "drilling mud", or simply "mud") is pumped under pressure downward from the surface through the drill string, out the drill bit into the wellbore, and then upward back to the surface through the annular space between the drill string and the wellbore. The drilling fluid, which may be water-based or oil-based, is typically viscous to enhance its ability to carry wellbore cuttings to the surface. The drilling fluid can perform various other valuable functions, including enhancement of drill bit performance (e.g., by ejection of fluid under pressure through ports in the drill bit, creating mud jets that blast into and weaken the underlying formation in advance of the drill bit), drill bit cooling, and formation of a protective cake on the wellbore wall (to stabilize and seal the wellbore wall).

Particularly since the mid-1980s, it has become increasingly common and desirable in the oil and gas industry to use "directional drilling" techniques to drill horizontal and other non-vertical wellbores, to facilitate more efficient access to and production from larger regions of subsurface hydrocarbon-bearing formations than would be possible using only vertical wellbores. In directional drilling, specialized drill string components and "bottomhole assemblies" (BHAs) are used to induce, monitor, and control deviations in the path of the drill bit, so as to produce a wellbore of desired non-vertical configuration.

Directional drilling is typically carried out using a downhole motor (commonly referred to as a "mud motor") incorporated into the drill string immediately above the drill bit. A typical prior art mud motor includes several primary components, as follows (in order, starting from the top of the motor assembly):

- a top sub adapted to facilitate connection to the lower end of a drill string ("sub" being the common general term in the oil and gas industry for any small or secondary drill string component);
- a power section comprising a positive displacement motor of well-known type, with a helically-vaned rotor eccentrically rotatable within a stator section;
- a drive shaft housing configured to be straight, bent, or incrementally adjustable between zero degrees and a maximum angle;
- a drive shaft enclosed within the drive shaft housing, with the upper end of the drive shaft being operably connected to the rotor of the power section; and
- a bearing section comprising a cylindrical mandrel coaxially and rotatably disposed within a cylindrical housing, with an upper end coupled to the lower end of the drive shaft, and a lower end adapted for connection to a drill bit.

The mandrel is rotated by the drive shaft, which rotates in response to the flow of drilling fluid under pressure through the power section. The mandrel rotates relative to the cylindrical housing, which is connected to the drill string.

Conventional mud motors include power sections that use either a Moineau drive system or a turbine-type drive system. These types of power sections are relatively long, with typical lengths of 15-20 feet for Moineau-type power sections and 20-30 feet for turbines for motor sizes between 5" and 8" in diameter. For directional drilling with a bent motor assembly, it is optimal to position the bend within a few feet of the bit in order to achieve suitable levels of hole curvature and reasonable steerability of the assembly. Having the bend located above the power section or turbine would be too great a distance from the bit to be effective, so this requires the bend to be located below the power section or turbine. The bend is typically incorporated within the drive shaft housing. The driveshaft typically comprises universal joints to accommodate the angular misalignment between the power section and bearing assembly, as well as the eccentric operation in the case of a Moineau power section. The driveshaft U-joints and threaded connections are typically the weakest parts of the motor assembly and the most common locations for fractures to occur.

U.S. Pat. No. 6,280,169, U.S. Pat. No. 6,468,061, U.S. Pat. No. 6,939,117, and U.S. Pat. No. 6,976,832 (all of which are hereby incorporated by reference in their entirety) disclose similar types of fluid-powered rotary drive mechanisms. These mechanisms are capable of outputting levels of rotary speed and torque comparable to Moineau and turbine-type power sections, but in power sections as short as one to three feet in length. These mechanisms comprise a system of longitudinal lobes and gates, with intake and exhaust ports for directing fluid to build pressure between the lobes and gates to drive the rotation of the motor. The mechanisms operate with concentric rotation between the inner shaft and outer housing. The shorter length and concentric operation allow any of these drive systems to be incorporated directly within or attached to the mud motor bearing assembly, with no need for a driveshaft assembly with universal joints. The fixed or adjustable bent housing can be attached above the drive section while maintaining a bit-to-bend length that is as short as or shorter than in conventional downhole motors.

The resulting overall length of the motor is dramatically shorter than in conventional assemblies.

These drive mechanisms do not require any elastomeric elements, in contrast to Moineau-type drive systems which incorporate elastomeric stator elements that limit the operational temperature for a Moineau-type system to a maximum of about 325-350° F. Additionally, the performance of Moineau-type drive systems tapers off sharply above 140° F. Therefore, these concentrically-operating drive systems are suitable for use in extremely high temperature and geothermal applications (500+ degrees F.) that are beyond the limits of Moineau-type systems, with little or no drop in performance.

BRIEF SUMMARY

The present disclosure teaches a downhole motor incorporating a drive system comprising a system of longitudinal lobes and gates, with intake and exhaust ports for directing fluid to build pressure between the lobes and gates to drive the rotation of the motor. Preferably, the drive system is connected concentrically to the bearing assembly while maintaining a short enough length to allow the bent housing to be located above the drive section, and negating the need for a driveshaft to connect the drive section to the bearing section as in prior art mud motors. Alternatively, the bend may be positioned below the drive section in combination with the use of a driveshaft assembly to connect the drive section to the bearing section, in order to position the bend as close as possible to the bit.

In a first aspect, the present disclosure teaches a rotary fluid drive system comprising:

a first body and a second body, with a selected one of the bodies being coaxially disposed inside the other body to define a working fluid space therebetween, and with the second body being rotatable relative to the first body about a rotational axis;

at least one gate supported by a selected one of the first and second bodies, such that each gate can swing or pivot about an axis parallel to the rotational axis;

at least one lobe provided on the body not supporting the at least one gate;

one or more fluid inlet ports directing fluid flow into the working fluid space; and one or more fluid outlet ports axially spaced from the fluid inlet ports and directing fluid flow out of the working fluid space;

wherein:

for each gate, the body supporting the at least one gate defines a gate pocket into which the associated gate can swing when contacted by a lobe;

each gate pocket and associated gate are relatively configured to form a debris chamber therebetween, capable of accommodating debris when the associated gate is disposed therewithin; and the rotary fluid drive system defines a fluid path through which a working fluid can enter and exit the drive system, wherein the fluid path includes the one or more fluid inlet ports, the working fluid space, and the one or more fluid outlet ports, such that a flow of a working fluid along the fluid path will cause rotation of the second body relative to the first body.

In certain embodiments, each gate and its associated gate pocket are relatively configured to form at least one gate pocket flow path through which fluid can flow from between the gate pocket and the gate and into the working fluid space, when the gate has swung to a maximum extent into the gate pocket. In such embodiments, each gate (which will have a free longitudinal edge) and its associated gate pocket may be relatively configured so that when a gate has swung to the maximum extent into its associated gate pocket, the longitudinal edge will face and be spaced from a wall of the gate pocket so as to create a downstream portion of the gate pocket flow path.

In certain embodiments, a plurality of spaced projections may be formed on a surface of each gate surface facing its associated gate pocket, with the space or gap between adjacent projections creating an associated upstream portion of the pocket flow path. In such embodiments, the projections and the gate pockets may be relatively configured such that the projections can abut a surface of the gate pocket when the gate is swung to the maximum extent into its associated gate pocket. Preferably, though not necessarily, the projections will be evenly spaced along a length of a respective gate. The gaps between the projections may be sized such that the cumulative length of the gaps on each gate will correspond to at least 10% of the length of the gate. In alternative embodiments, the cumulative length of the gaps may correspond to at least 30% of the gate length, and in other embodiments it may correspond to up to 90% of the gate length.

Preferably, though not necessarily, each gate may have associated biasing means (such as a spring, by way of non-limiting example) to bias the gate to swing in a direction away from its associated gate pocket and toward the body provided with the at least one lobe. In embodiments provided with biasing means comprising a spring, the spring may extend along and within a longitudinal bore formed in the associated gate. In such embodiments, one end of each spring may be held rotationally fixed relative to the associated gate; optionally, that end of each spring may be keyed into a portion of the body provided with the gate pockets.

The inlet ports may be located upstream of the outlet ports, having reference to a direction of flow of the working fluid along the fluid path.

The rotary fluid drive may include a flow control mechanism disposed within the second body at a selected point between the one or more fluid inlet ports and the one or more fluid outlet ports.

In certain embodiments of the rotary fluid drive, the first body is disposed inside the second body. In alternative embodiments, the second body is disposed inside of the first body.

In a second aspect, the present disclosure teaches a rotary fluid drive system comprising:

a first body and a second body, with a selected one of the bodies being coaxially disposed inside the other body to define a working fluid space therebetween, and with the second body being rotatable relative to the first body about a rotational axis;

at least one gate supported by a selected one of the first and second bodies, such that each gate can swing or pivot about an axis parallel to the rotational axis;

at least one lobe provided on the body not supporting the at least one gate;

one or more fluid inlet ports directing fluid flow into the working fluid space; and one or more fluid outlet ports axially spaced from the fluid inlet ports and directing fluid flow out of the working fluid space;

wherein:

for each gate, the body supporting the at least one gate defines a gate pocket into which the associated gate can swing when contacted by a lobe;

each gate has a surface facing the associated gate pocket and having a plurality of projections, with gaps between adjacent projections defining a gate pocket flow path;

the rotary fluid drive system defines a fluid path through which a working fluid can enter and exit the drive system, wherein the fluid path includes the one or more fluid inlet ports, the working fluid space, and the one or more fluid outlet ports, such that a flow of a working fluid along the fluid path will cause rotation of the second body relative to the first body; and a working fluid can flow via each gate pocket flow path from the associated gate pocket into the working fluid space when the associated gate is maximally deflected into its associated gate pocket.

In certain embodiments, each gate (which will have a free longitudinal edge) and its associated gate pocket may be relatively configured so that when a gate has swung to the maximum extent into its associated gate pocket, the longitudinal edge will face and be spaced from a wall of the gate pocket so as to create a downstream portion of the gate pocket flow path.

Preferably, though not necessarily, the projections will be evenly spaced along a length of a respective gate. The gaps between the projections may be sized such that the cumulative length of the gaps on each gate will correspond to at least 10% of the length of the gate. In alternative embodiments, the cumulative length of the gaps may correspond to at least 30% of the gate length, and in other embodiments it may correspond to up to 90% of the gate length.

Preferably, though not necessarily, each gate may have associated biasing means (such as a spring, by way of non-limiting example) to bias the gate to swing in a direction away from its associated gate pocket and toward the body provided with the at least one lobe. In embodiments provided with biasing means comprising a spring, the spring may extend along and within a longitudinal bore formed in the associated gate. In such embodiments, one end of each spring may be held rotationally fixed relative to the associated gate; optionally, that end of each spring may be keyed into a portion of the body provided with the gate pockets.

The inlet ports may be located upstream of the outlet ports, having reference to a direction of flow of the working fluid along the fluid path.

The rotary fluid drive may include a flow control mechanism disposed within the second body at a selected point between the one or more fluid inlet ports and the one or more fluid outlet ports.

In a third aspect, the present disclosure teaches a drilling motor including:

a bearing assembly comprising: a generally cylindrical housing having an upper end and a lower end; a generally cylindrical mandrel having an upper end, a lower end, and a longitudinal bore, with the mandrel being coaxially disposed within the housing so as to be rotatable relative thereto about a rotational axis; radial bearing means disposed in an annular space between the housing and the mandrel; and thrust bearing means disposed in an annular space between the housing and the mandrel;

a generally cylindrical rotor having an upper end, a lower end, and a longitudinal bore, with the rotor being coaxially disposed within the housing so as to define a generally annular working fluid space therebetween, and with the rotor operatively engaging the mandrel so as to be rotatable therewith;

a plurality of elongate gates;

at least one axially-oriented lobe engageable with the gates during relative rotation between the rotor and the housing;

one or more fluid inlets allowing fluid flow from an upper region of the rotor bore into the working fluid space; and one or more fluid outlets allowing fluid flow out of the working fluid space into a lower region of the rotor bore;

wherein the drilling motor defines a fluid path including the fluid inlets, the working fluid space, and the fluid outlets, such that a flow of a working fluid along the fluid path will cause relative rotation between the rotor and the housing, thereby causing each lobe to deflect each gate in sequence.

In some embodiments, the gates may be supported by the housing and pivotable about a pivot axis parallel to the rotational axis. In other embodiments, the gates may be supported by the rotor and pivotable about a pivot axis parallel to the rotational axis. In still other embodiments, the gates may be radially-actuating and supported by the housing or, alternatively, radially-actuating and supported by the rotor.

The drilling motor may include biasing means associated with the gates, for biasing the gates away from the component supporting the gates.

The drilling motor may be configured such that the mandrel engages the rotor so as to be coaxially rotatable therewith. Such coaxially rotatable engagement of the mandrel and the rotor may be effected by any functionally effective means, such as, without limitation:

- by means of a splined connection, with an upper portion of the mandrel coaxially disposed within the bore of the rotor;
- by means of respective mating lugs provided on the upper end of the mandrel and the lower end of the rotor;
- by means of a clutch mechanism disposed between the upper end of the mandrel and the lower end of the rotor;
- by means of a gear box disposed between the upper end of the mandrel and the lower end of the rotor;
- by means of a generally cylindrical coupling having a lower section with internal threading matingly engageable with external threading on the upper end of the mandrel, and having an upper section with internal splines matingly engageable with external splines on the lower end of the rotor;
- by means of a drive shaft having an upper end rigidly and coaxially engaging the lower end of the rotor, and a lower end incorporating a universal joint which engages a drive shaft housing coupled to the upper end of the mandrel; or
- by means of a drive shaft having an upper end incorporating an upper universal joint engaging an upper drive shaft housing coupled to the lower end of the rotor, and a lower end incorporating a lower universal joint which engages a drive shaft housing coupled to the upper end of the mandrel.

The housing of the drilling motor may incorporate a bent sub, which optionally may be either a fixed bent sub or an adjustable bent sub. In certain embodiments the bent sub will be located above the rotor; generally speaking, however, the location of the bent sub, when provided, will be a matter of design choice having regard to operational parameters. For example, in some embodiments a bent sub may be positioned below the rotor. In embodiments incorporating a drive shaft coaxially engaging the rotor and engaging the mandrel by means of a universal joint, a bent sub may be positioned proximal to the universal joint. In embodiments incorporating a drive shaft having upper and lower universal joints, a bent sub may be positioned between the universal joints.

In certain embodiments, the radial bearing means may be adapted to transfer radial loads from the mandrel to the housing through the rotor, such as, by way of non-limiting example, by adapting the rotor to serve as a radial bearing.

Optionally, the drilling motor may comprise flow control means, for altering the characteristics of fluid flow through the motor to regulate the rotational speed of the motor. In certain embodiments, the flow control means may be configured to allow fluid to bypass the working fluid space when the pressure differential across the working fluid space exceeds a pre-set value. In other embodiments, the flow control means may comprise, by way of non-limiting example:

- a relief valve coaxially disposed within the rotor;
- a plate integral with a selected one of the mandrel and the rotor, and positioned to separate flow between the fluid inlets and the fluid outlets;
- a nozzle for continuously bypassing a portion of the fluid flow through the rotor;
- a burst disc positioned to separate flow between the fluid inlets and the fluid outlets; or
- means for diverting fluid to the exterior of the housing.

BRIEF DESCRIPTION OF THE DRAWINGS

Embodiments in accordance with the present disclosure will now be described with reference to the accompanying Figures, in which numerical references denote like parts, and in which.

DETAILED DESCRIPTION

Figure 1:
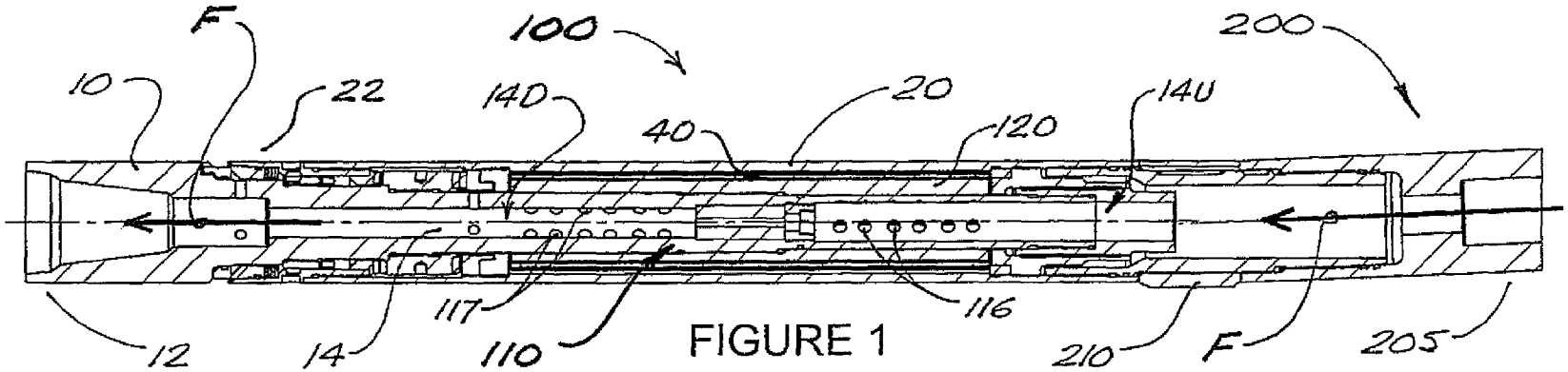
FIG. 1 is a longitudinal cross-section through a bearing assembly incorporating an embodiment of a rotary drive system in accordance with the present disclosure.

The Figures illustrate various embodiments of downhole motors in accordance with the present disclosure. FIG. 1 illustrates a bearing assembly 100 comprising a first embodiment 110 of a concentric rotary drive system connected at its upper end to the lower end of a bent housing 200, which incorporates a fixed or adjustable bent sub 210. Although the illustrated bearing assembly incorporates a bent housing, it is to be understood that this is not essential, as the bearing assembly and rotary drive systems in accordance with the present disclosure could alternatively be run without a bent housing (i.e., when drilling a straight or undeviated section of a wellbore).

Bearing assembly 100 includes an elongate mandrel 10 coaxially disposed within a generally cylindrical housing 20 so as to be rotatable relative thereto, with the lower end 12 of mandrel 10 projecting from the lower end 22 of housing 20 and being adapted for connection to a drill bit or other BHA components below the motor. Mandrel 10 has a central bore 14 for passage of a working fluid such as a drilling fluid. The upper end 205 of bent housing 200 is adapted for connection to the drill string or to other BHA components above the motor.

Figure 2:
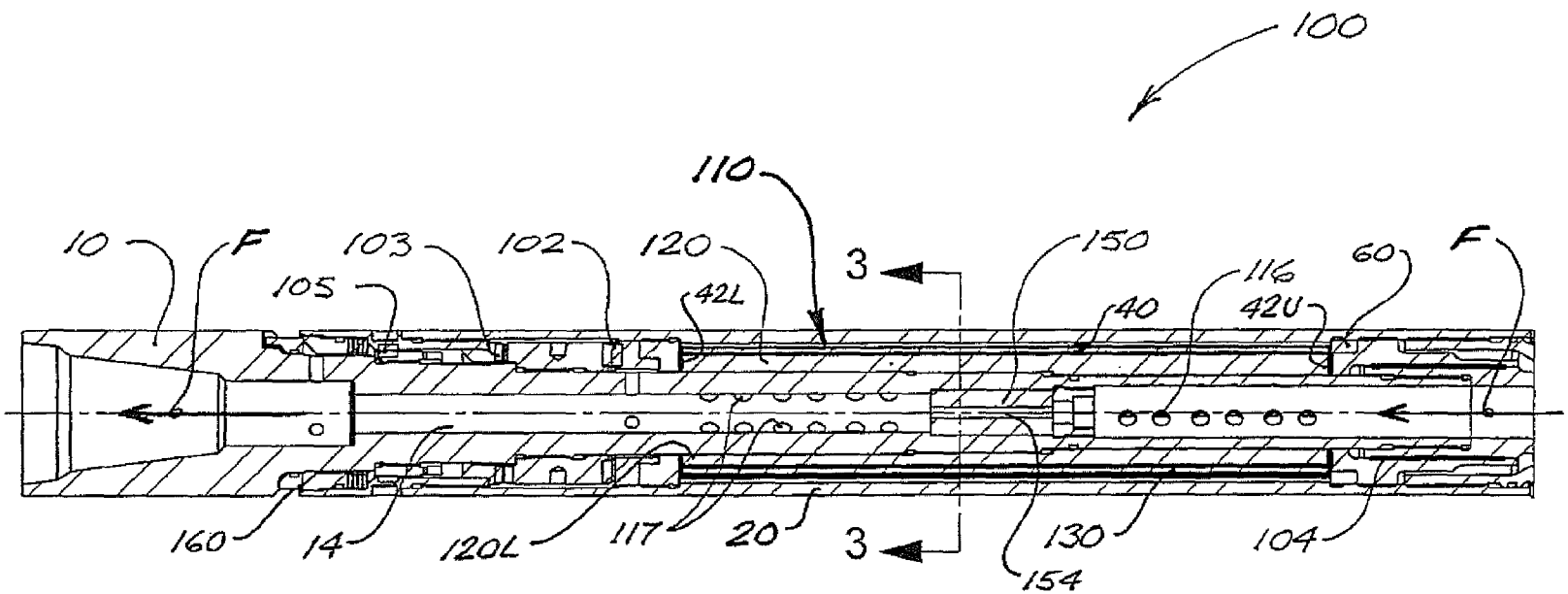
FIG. 2 is an enlarged longitudinal cross-section through the bearing assembly and rotary drive system shown in FIG. 1.
Figure 3:
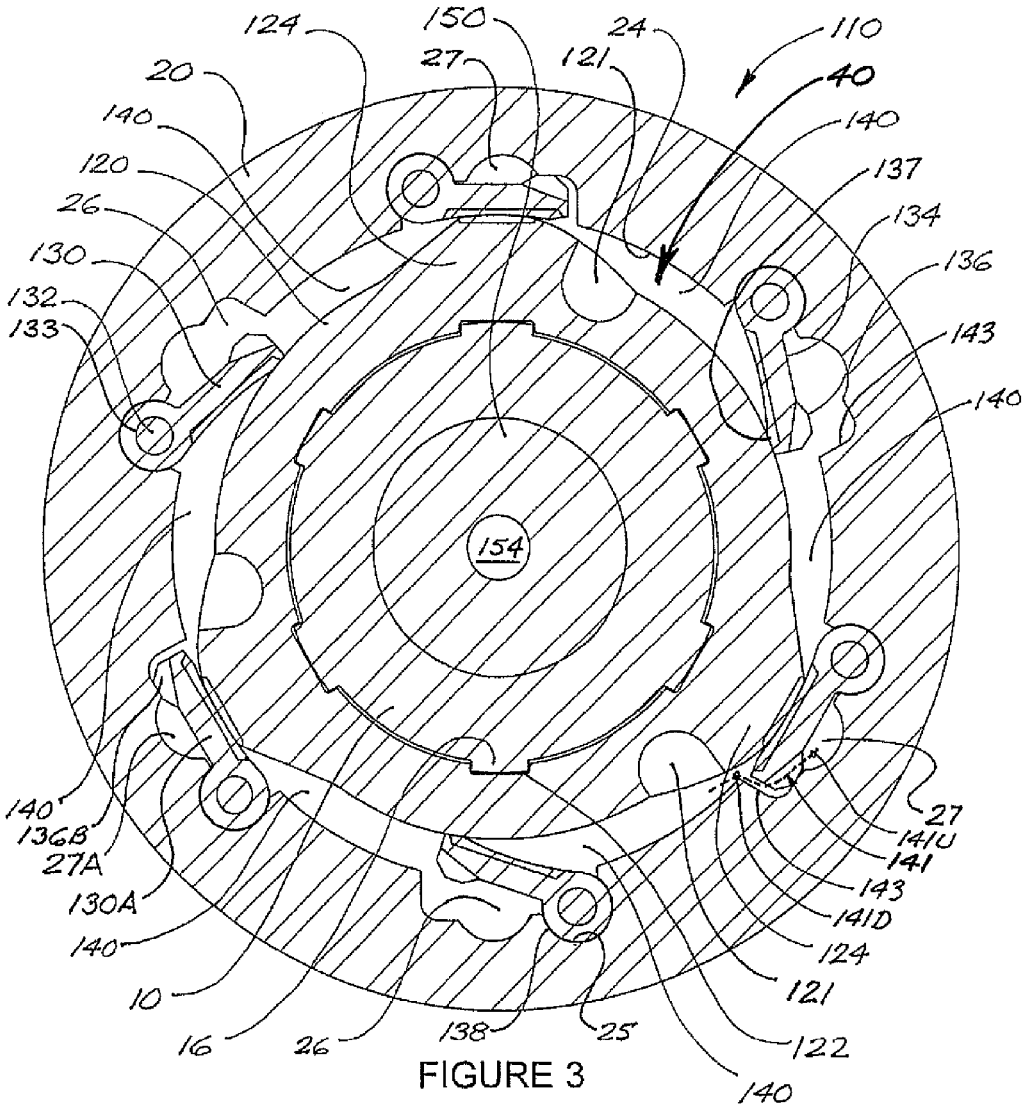
FIG. 3 is a transverse cross-section through the rotary drive system shown in FIGS. 1 and 2.

The primary features of the bearing assembly 100 and rotary drive system 110 in FIG. 1 are illustrated in greater detail in FIGS. 2 and 3. Rotary drive system 110 includes a generally cylindrical central shaft 120 (alternatively referred to as rotor 120) concentrically coupled to mandrel 10 so as to be rotatable therewith, and within housing 20. Accordingly, a generally annular space 40 is formed between rotor 120 and housing 20. Annular space 40 is alternatively referred to herein as a working fluid space 40. End plates 42U and 42L are fixed within housing 20 and define the upper and lower boundaries of working fluid space 40. End plates 42U and 42L also serve to constrain the axial position of rotor 120 relative to housing 20.

In the illustrated embodiment, rotor 120 is concentrically coupled to mandrel 10 by means of a splined connection as shown in FIG. 3, with splines 16 projecting from the outer surface of mandrel 10 engaging mating grooves 122 on the inner surface of the bore of rotor 120. However, rotor 120 could be co-rotatably coupled to mandrel 10 by other means. By way of non-limiting example only, mandrel 10 and rotor 120 could abut each other in end-to-end relation, while being rotatably coupled by a mechanism comprising mating axially-aligned lugs on each component, as in the alternative embodiment shown in FIG. 9 (in which the mating lugs on mandrel 10 and rotor 120 are indicated by reference numbers 19 and 129 respectively). Other exemplary means for rotatably coupling mandrel 10 and rotor 120 in end-to-end relation include threaded connections, splined connections, gear boxes, and clutch mechanisms in accordance with known technologies.

Figure 12:
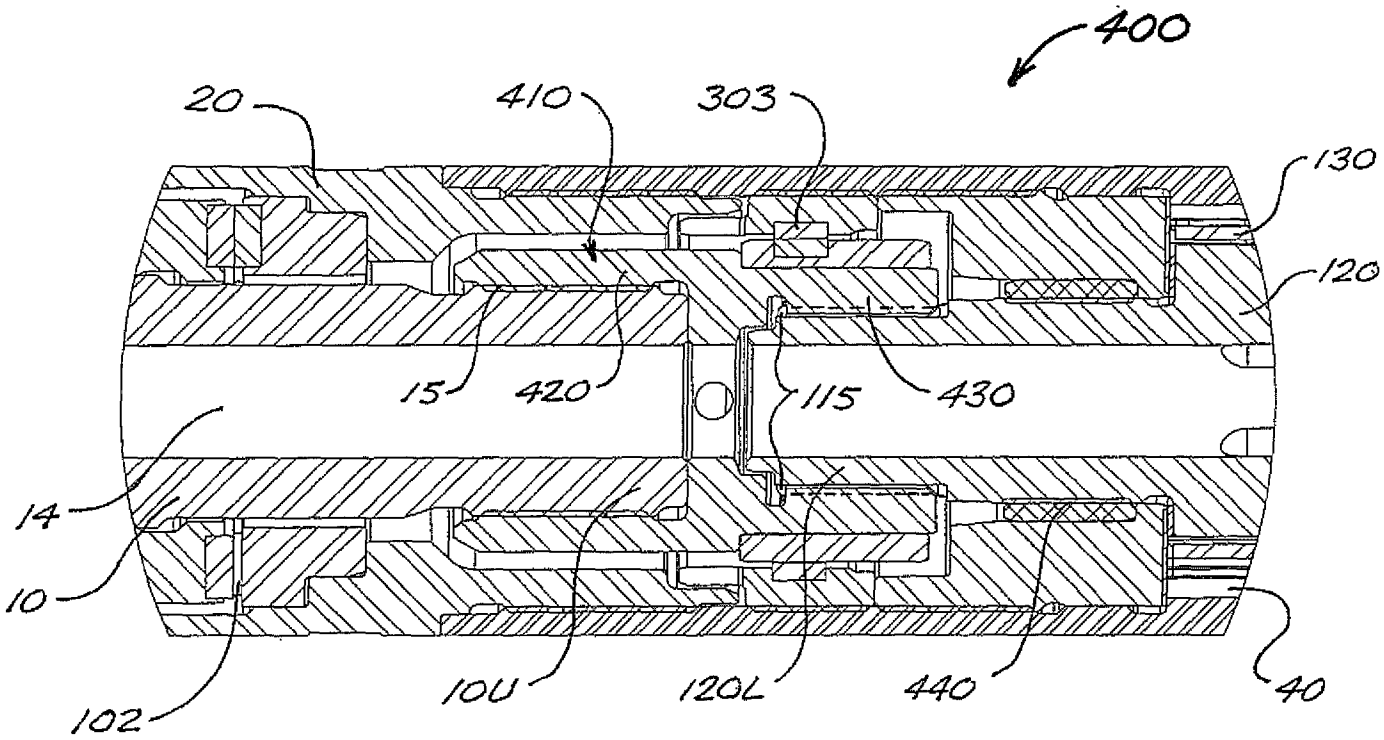
FIG. 12 is a cross-sectional detail of an end-to-end connection between the rotor and mandrel in an alternative embodiment of a rotary drive system in accordance with the present disclosure, using a threaded and splined connector.

By way of non-limiting example, FIG. 12 depicts an alternative embodiment 400 of a bearing section incorporating a rotary drive system in accordance with the present disclosure, in which a threaded and splined coupling 410 is used to transfer torque from rotor 120 to mandrel 10. In this embodiment, rotor 120 is supported by its own set of radial bearings 440 on both ends of the rotor (only lower radial bearings 440 are shown in FIG. 12).

Figure 12B:
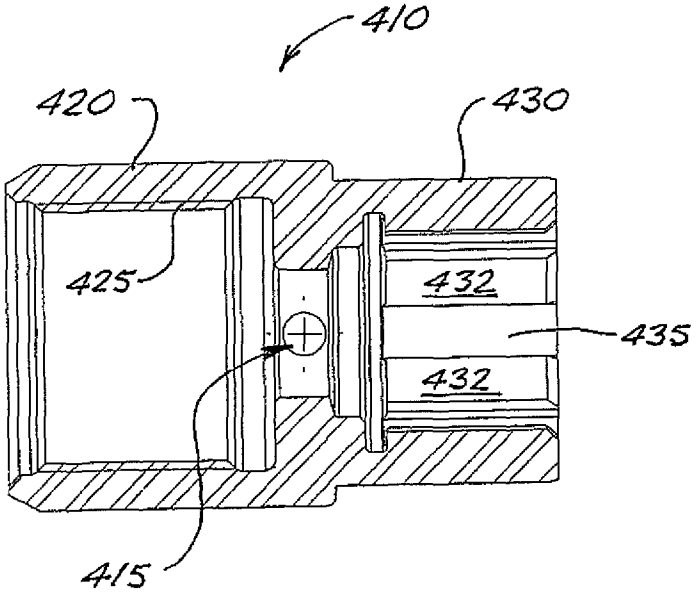
FIGS. 12A and 12B are isometric and cross-sectional views, respectively, of the threaded and splined connector in FIG. 12.
Figure 12A:
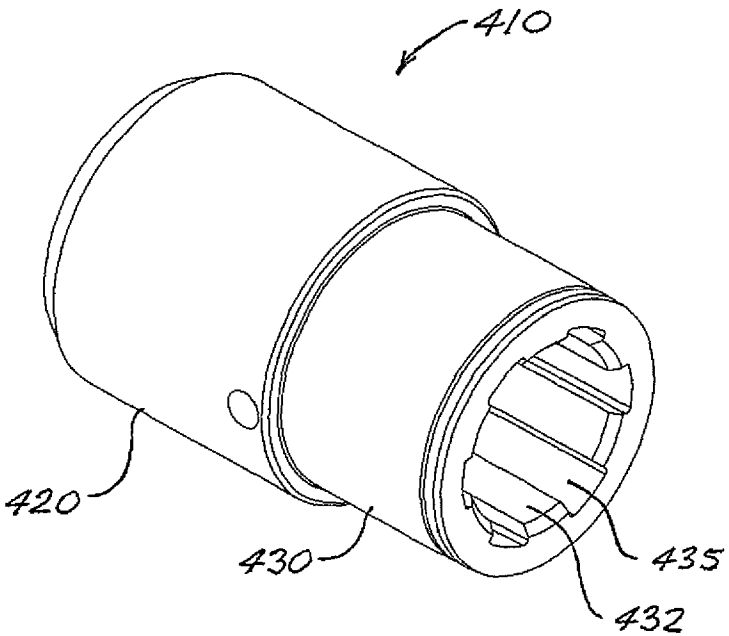

As shown in FIGS. 12, 12A, and 12B, coupling 410 comprises a lower cylindrical section 420 having internal threading 425, and an upper generally cylindrical section 430 the bore of which defines longitudinal splines 432 and grooves 435. Upper and lower sections 430 and 420 are coaxially contiguous, with a central bore 415 in the transition section between upper and lower sections 430 and 420. The upper end 10U of mandrel 10 in this embodiment is provided with external threading 15 engageable with internal threading 425 in lower section 420 of coupling 410. The lower end 120L of rotor 120 is formed with splines 115 engageable with grooves 435 on upper section 430 of coupling 410.

As shown in FIGS. 1, 2, 5, 7, and 8, fluid inlet ports 116 are provided through mandrel 10 and rotor 120 in an upstream region of rotor 120 to allow fluid flow from mandrel bore 14 into working fluid space 40, and fluid outlet ports 117 are provided through rotor 120 and mandrel 10 in a downstream region of rotor 120 to allow fluid flow from working fluid space 40 back into mandrel bore 14. Accordingly, rotary drive system 110 can be considered as defining a fluid path through the rotary drive system, extending between a fluid intake zone in an upstream region 14U of mandrel bore 14, through inlet ports 116 into working fluid space 40, and out of working fluid space 40 through outlet ports 117 into a fluid exit zone in a downstream region 14D of mandrel bore 14 proximal to the lower end 120L of rotor 120, from which zone fluid flow can continue within mandrel bore 14 toward the bit.

As best seen in FIGS. 3, 5, 7, and 8 the outer perimeter surface of rotor 120 defines a plurality of uniformly-spaced longitudinal rotor lobes 124. As best seen in FIGS. 3, 5, 6, 7, and 8, a plurality of elongate gates 130 are pivotably mounted within respective elongate gate-receiving pockets 26 in the inner surface 24 of the bore of housing 20.

Figure 4:
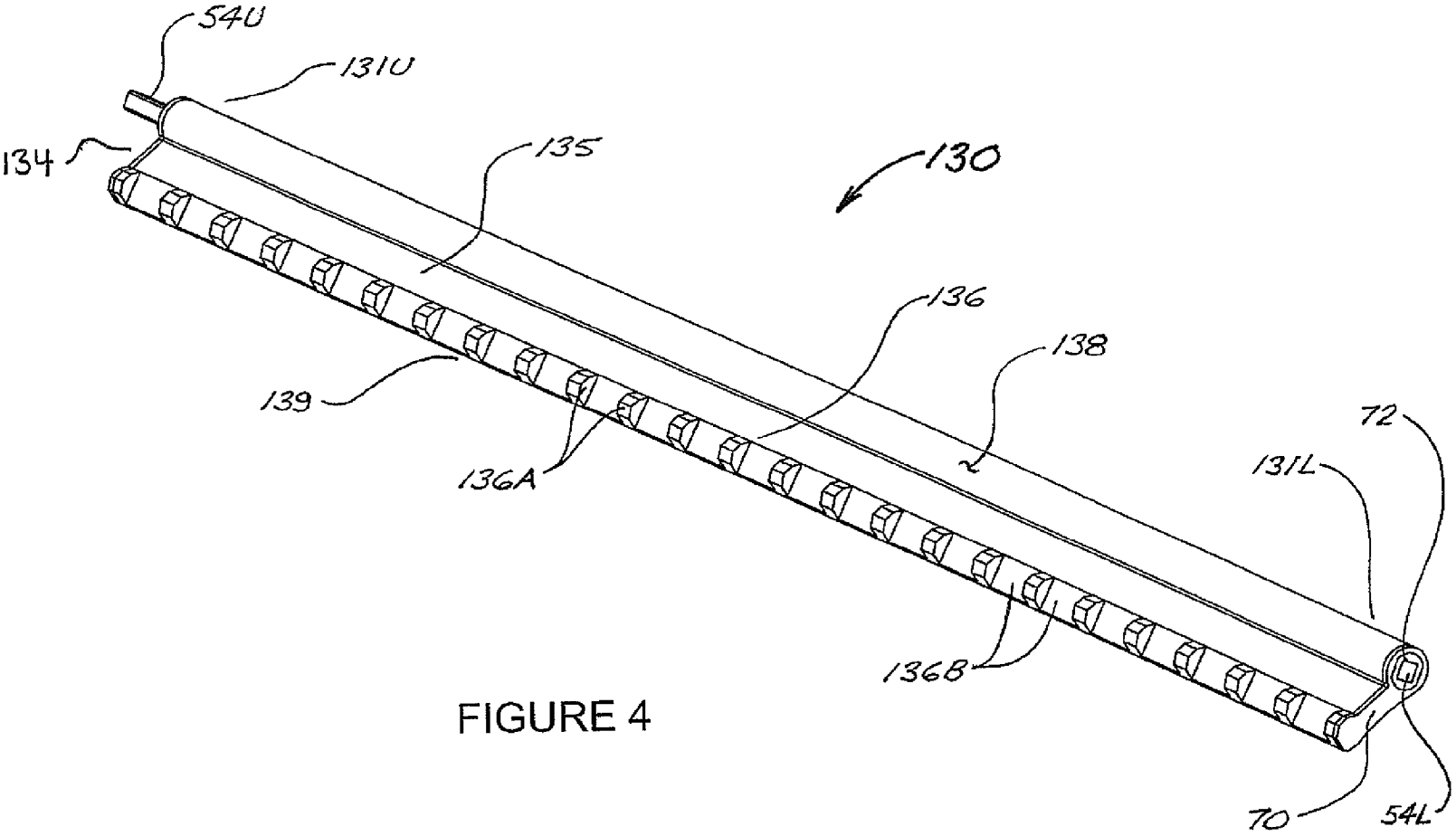
FIG. 4 is an isometric view of one embodiment of one of the gates used in the rotary drive system shown in FIG. 3.

FIG. 4 illustrates one embodiment of a gate 130 in accordance with the present disclosure. In this embodiment, gate 130 has ends 131 (which may be designated upper and lower ends 131U and 131L depending on the orientation of gate 130 in a given embodiment of the drive system) and an elongate blade member 134 with a first blade surface 135 oriented toward the associated gate pocket 26. The radially-outer end of blade member 134 has a longitudinal free edge 139 configured for substantially fluid-tight contact with the outer surfaces of rotor 120 (including, as the operational case may be, rotor lobes 124). Free edge 139 of blade member 134 preferably (but not necessarily) has a thickened or bulbous section 136 projecting from first blade surface 135. Thickened section 136 may be continuous or, as shown in FIGS. 3-8, it may form a plurality of spaced projections 136A extending from blade surface 135 toward the associated gate pocket 26, with gaps 136B being formed between adjacent projections 136A.

The inner surface 24 of the bore of housing 20 is formed with elongate gate pockets 26 such that as lobed rotor 120 rotates within housing 20, rotor lobes 124 will sequentially engage gates 130 and deflect them into their associated gate pockets 26 in housing 20 so that rotor lobes 124 can pass by. Each gate 130 thus pivots between a lowered position (i.e., in contact with or closely adjacent to rotor 120) when located between adjacent rotor lobes 124, and a raised (or deflected) position when displaced into its associated gate pocket 26 by a passing rotor lobe 124.

Optionally, projections 136A and gate pockets 26 may be configured such that projections 136A of a given gate 130 will abut a surface of the associated gate pocket 26 when gate 130 is maximally deflected into gate pocket 26. Preferably, projections 136A are evenly spaced along the length of gate 130. In one embodiment, the cumulative length of gaps 136B, as measured along the length of gate 130, corresponds to at least 10% of the gate length. In an alternative embodiment, the cumulative length of gaps 136B corresponds to at least 30% of the gate length. In yet another embodiment, the cumulative length of gaps 136B corresponds to as much as 90% of the gate length.

In preferred embodiments, each gate pocket 26 incorporates a debris slot or chamber 27, to accommodate or receive large particulate matter that might be present in the drilling fluid and which might otherwise impede full deflection of the associated gate 130 into gate pocket 26 by the passing rotor lobes 124. This can be best appreciated with reference to FIG. 3, in which an exemplary gate denoted by reference character 130A is shown fully deflected into its associated gate pocket 26A. Oversize matter carried by the drilling fluid can temporarily reside within debris chamber 27A as rotor lobes 124 pass by, rather than becoming lodged behind gate 130A and impeding full deflection of gate 130A into gate pocket 26A, as might otherwise happen if the gate pockets were configured to closely match the profile of gates 130.

Figure 7:
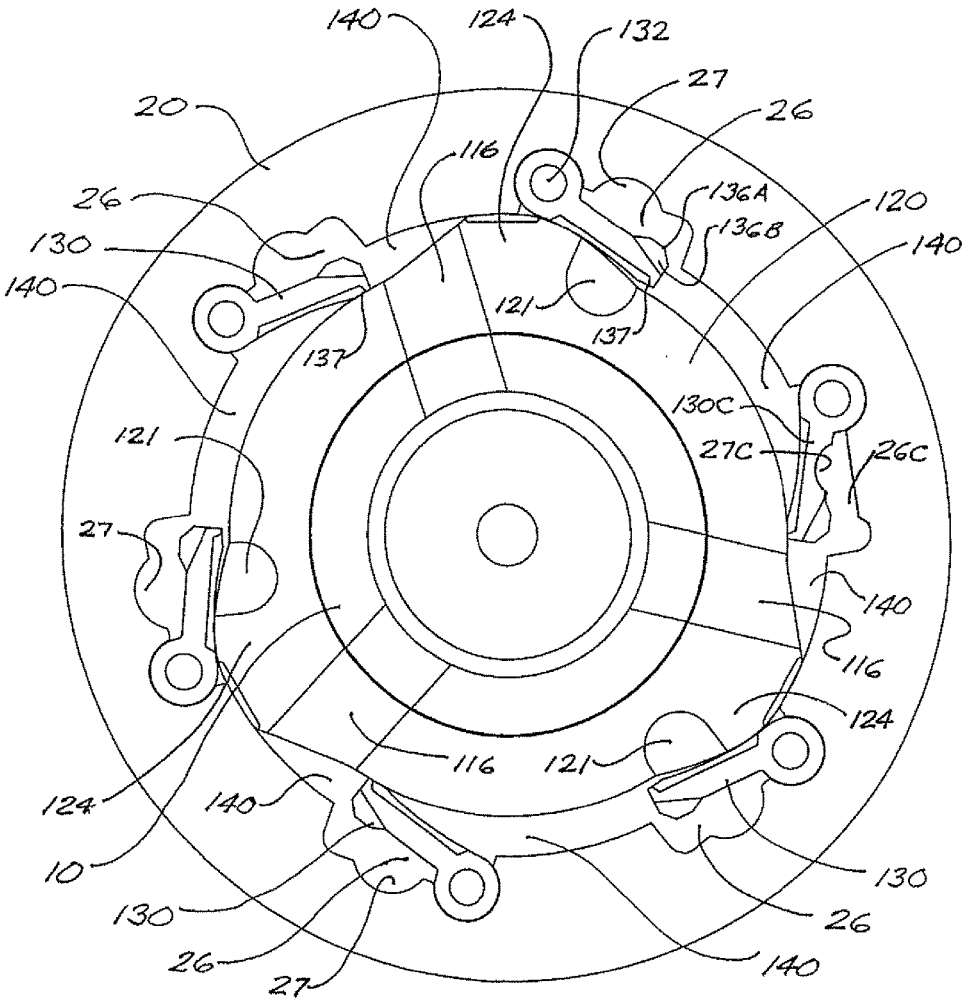
FIGS. 7 and 8 are cross-sections through the rotary drive system as in FIG. 3, showing the lobed shaft in different rotational positions relative to the housing.

FIG. 7 illustrates a variant gate denoted by reference number 130C, having a debris channel 27C formed in its outer face, and there is no debris chamber 27 formed into the variant gate pocket 26C associated with gate 130C.

Preferably, each gate 130 and associated gate pocket 26 are relatively configured to form at least one gate pocket flow path (denoted by dotted line 141 in FIG. 3), such that fluid can flow out of gate pocket 26 into working fluid space 40 even when gate 130 is maximally deflected into gate pocket 26. In the embodiment shown in FIG. 3, gate pocket flow path 141 includes an upstream portion 141U co-extensive with gaps 136B in thickened section 136. Gates 130 and gate pockets 26 are configured so that when a gate 130 is maximally deflected into its associated gate pocket 26, the gate's free longitudinal edge 139 is spaced from a longitudinal wall 143 of the gate pocket to create a downstream portion 141D of gate pocket flow path 141, in fluid communication with working fluid space 40.

As best understood with reference to FIGS. 2, 3, 7, and 8, with gates 130 being biased into substantially fluid-tight contact with rotor 120, working fluid space 40 between rotor 120 and housing 20 is divided into longitudinal chambers 140 between rotor lobes 124 and adjacent gates 130. Longitudinal chambers 140 are bound at either end by end plates 42U and 42L. In operation, a pressurized working fluid (such as drilling mud pumped from surface, as conceptually indicated by flow arrows F in various of the Figures) is introduced into rotary drive system 110 through inlet ports 116, thus pressurizing (at any given time) one or more longitudinal chambers 140 and inducing rotation of rotor 120 (and mandrel 10 along with it) relative to housing 20. Opposite the high pressure side of the lobe, the fluid is directed through fluid outlet ports 117 and onward through the bit.

Figure 8:
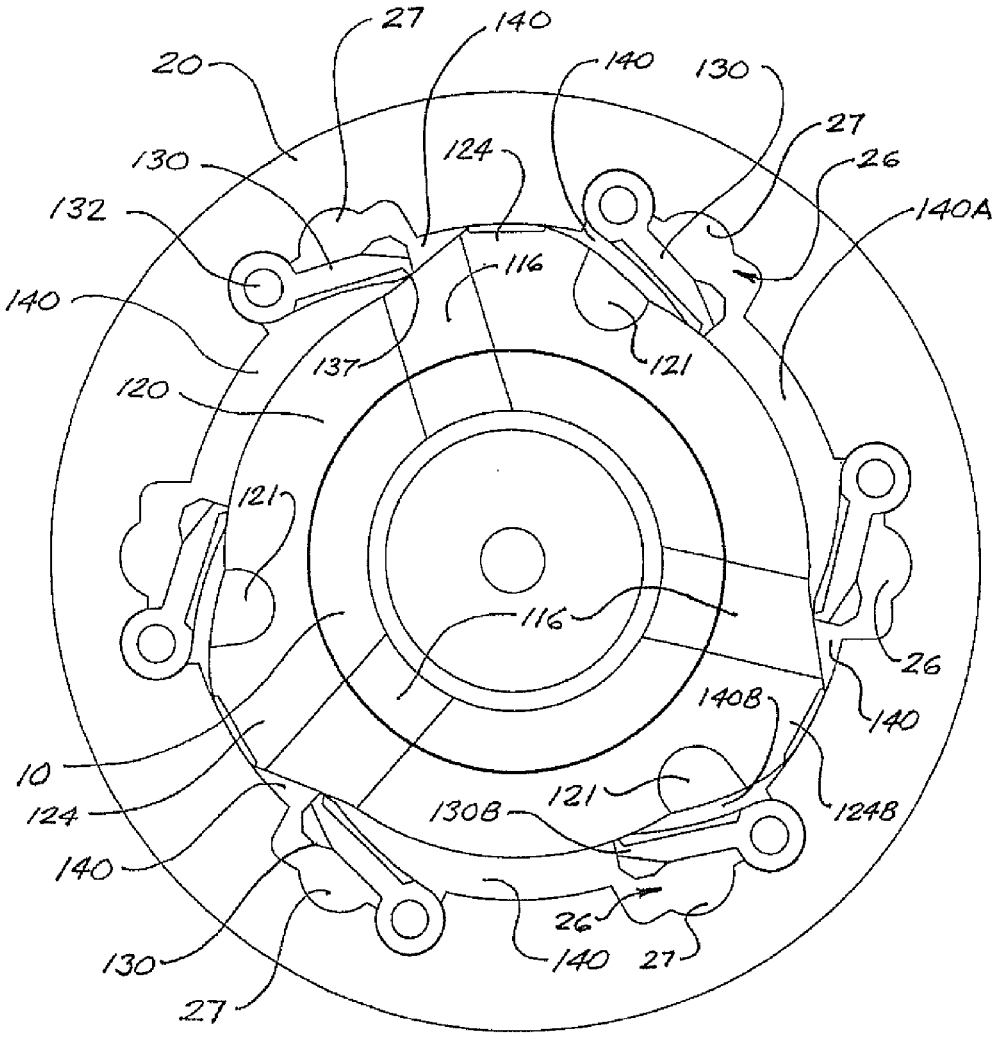

As may be appreciated with reference to FIGS. 7 and 8 in particular, the configuration and volume of each longitudinal chamber 140 will change as rotor 120 rotates within and relative to housing 20. For example, FIG. 8 illustrates a first longitudinal chamber denoted by reference character 140A having a comparatively large volume, and a second longitudinal chamber denoted by reference character 140B having a greatly reduced volume as a rotor lobe 124B approaches the associated gate 130B. Accordingly, fluid must be conveyed out of chambers 140 to prevent the build-up of excessive fluid pressure. This is accomplished in the illustrated embodiments by forming rotor 120 with pressure relief channels 121 to convey drilling fluid from chambers 140 to fluid outlet ports 117 (as may be seen in FIGS. 3 and 5).

The pivotability of gates 130 may be enabled by any suitable means, and embodiments within the scope of the present disclosure are not limited or restricted to the use of any particular pivoting means. To provide one non-limiting example, each gate 130 may be provided with a longitudinal pin bore 133 generally as shown in FIG. 3, for receiving elongate pivot pins, the ends of which are rotatably received within pockets or bearings associated with housing 20. In the specifically illustrated embodiments, however, gates 130 are pivotably retained within cylindrical pivot pockets 25 formed in housing 20. In the embodiment shown in FIG. 4, each gate 130 has an elongate convexly-cylindrical surface 138 which is matingly receivable within a corresponding cylindrical pivot pocket 25 to form a cylindrical pivot interface. In the illustrated embodiment, the cylindrical portions of pivot pockets 25 extend around an arc greater than 180 degrees, such the pivot pockets fully retain the gates without need for pivot pins as such; in effect, the portions of gates 130 having cylindrical surfaces 138 function as pivot pins.

Preferably, gates 130 are provided with biasing means for biasing gates 130 away from housing 20 and into substantially sealing contact with rotor 120. Such biasing means could comprise torsion rod springs, torsion coil springs, cam bodies, fluid pressure, or any other suitable mechanical or hydraulic means. In one embodiment, and with particular reference to FIGS. 4, 4A, and 4B, the biasing means may comprise torsion rods 50 disposed within pin bores 133 provided in gates 130 as shown in FIG. 3. Each torsion rod 50 has a central section 52 of circular cross-section extending between upper and lower end sections 54U and 54L which are configured for engagement with rotational restraint means.

Figure 4A:
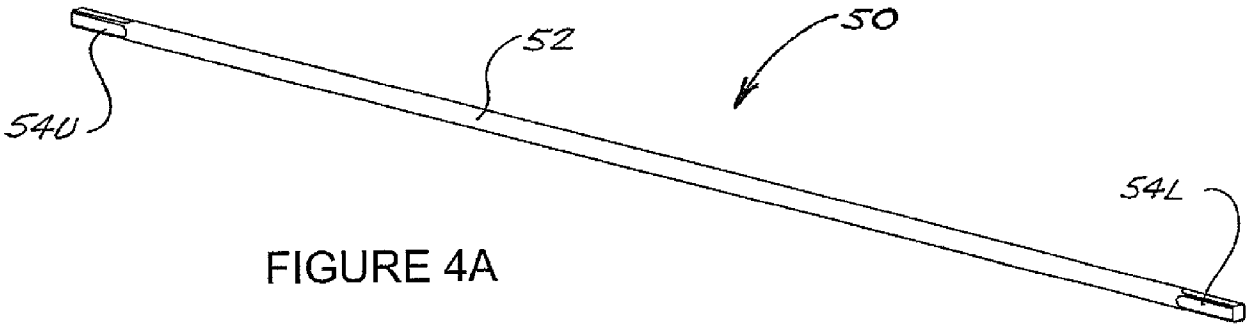
FIG. 4A is an isometric view of a torsion rod for use in conjunction with a gate as in FIG. 4.
Figure 4B:
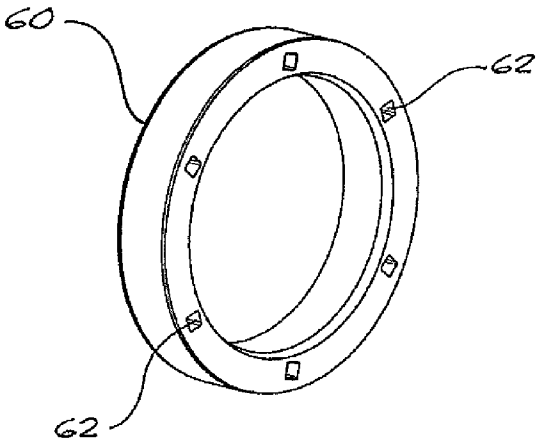
FIG. 4B is an isometric view of a gate preload ring for use in conjunction with torsion rods as in FIG. 4A.
Figure 5:
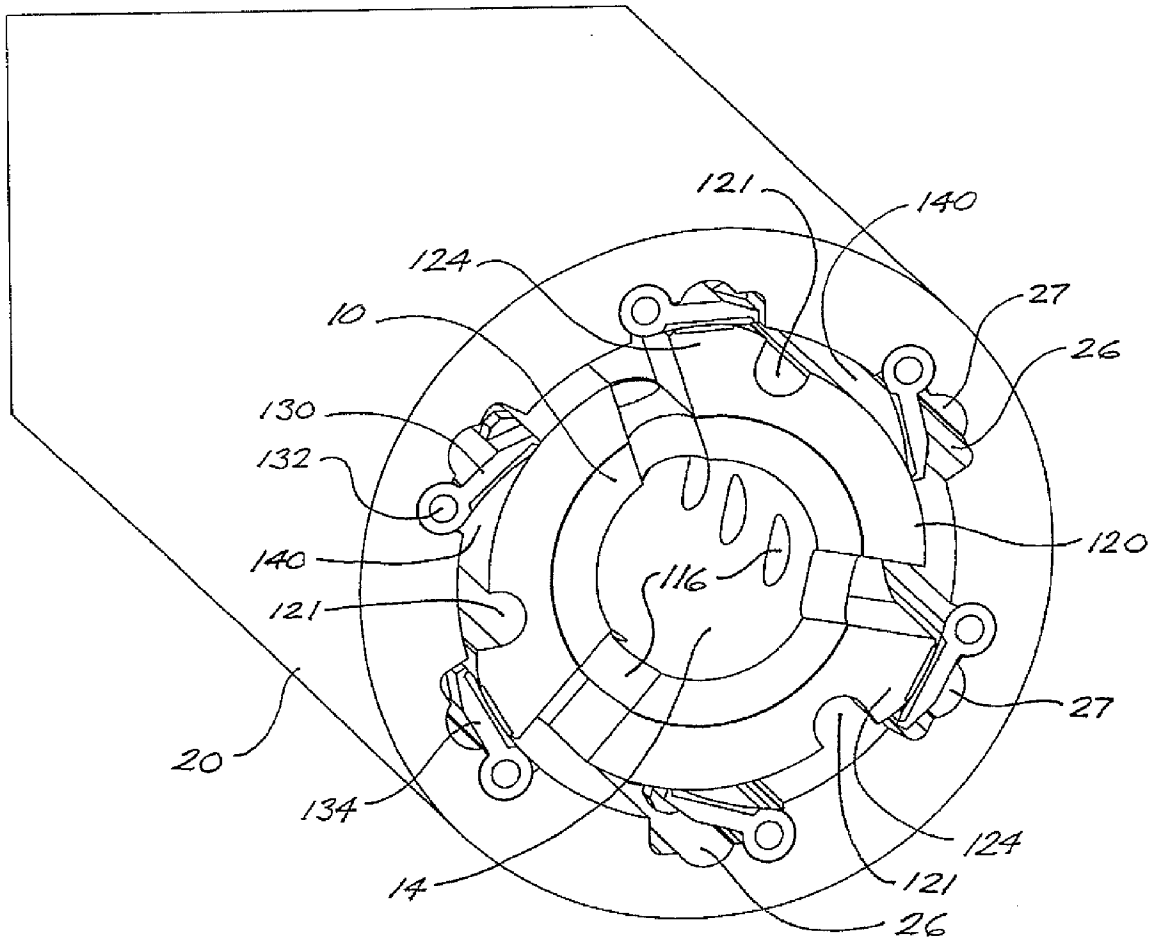
FIG. 5 is an isometric cross-section through the housing of the rotary drive system shown in FIGS. 1 to 3.
Figure 6:
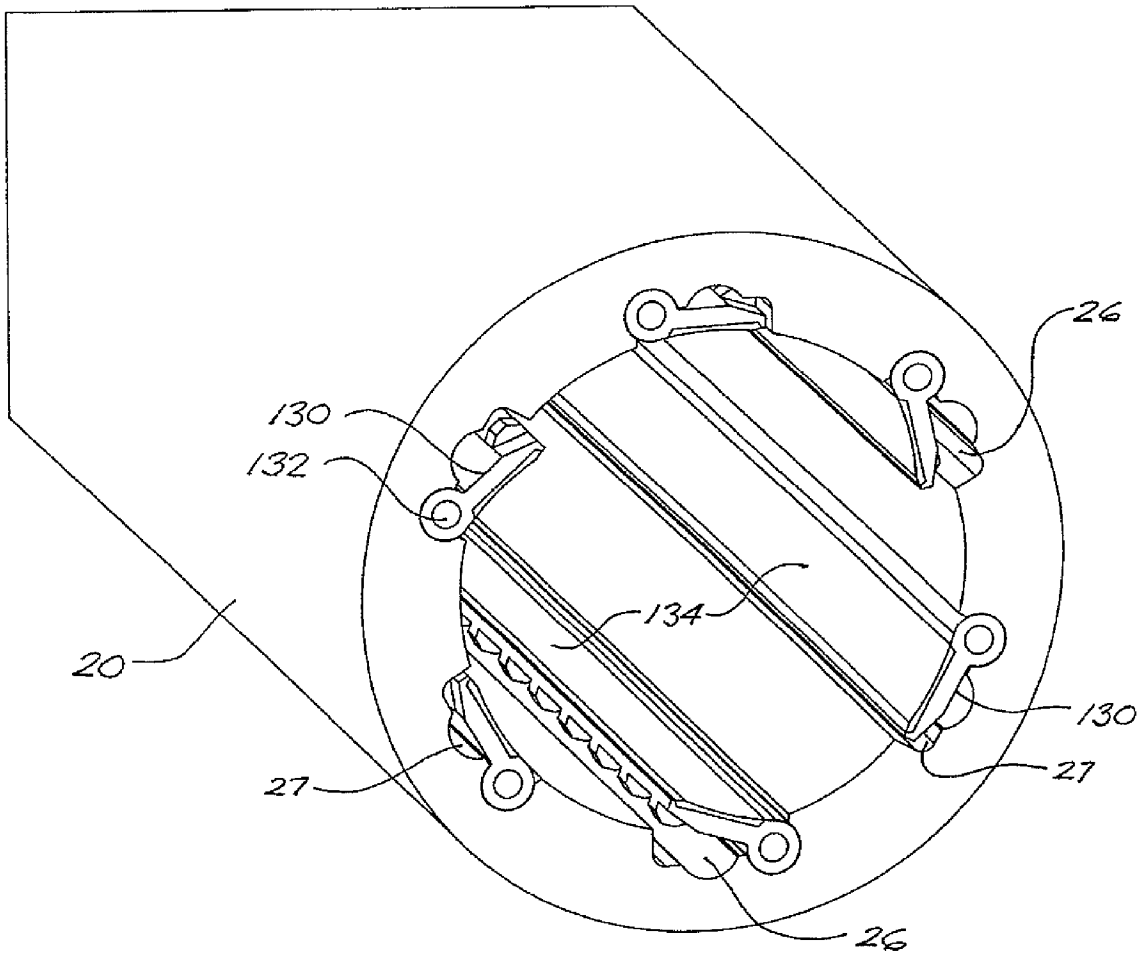
FIG. 6 is an isometric cross-section through the rotary drive system shown in FIGS. 1 to 3, but with the mandrel and rotor not shown.

In the embodiment shown in FIG. 4A, this rotational restraint is enabled by forming upper and lower end sections 54U and 54L to be square in cross-section. FIG. 4B illustrates a gate preload ring 60 having a plurality of square holes 62 corresponding in number to the number of gates 130 in the rotary drive system 110, with square holes 62 being sized for mating engagement with upper end section 54U of torsion rod 50. In the embodiment shown in FIGS. 1 and 2, preload ring 60 is coaxially fixed to housing 20 immediately above end plate 42U so as to be non-rotatable relative to housing 20, such that in the assembled drive system upper end 54U of each torsion rod 50, projecting from the upper end of its associated pin bore 133 at upper end 131U of the associated gate 130, will be matingly disposed within one of the square holes 62 in gate preload ring 60. The upper ends of torsion rods 50 will thus be restrained against rotation relative to housing 20, but the upper ends of torsion rods 50 will be unrestrained against rotation within the pin bores 133 of their associated gates 130 and relative to the upper ends 131U thereof.

However, as may be understood with reference to FIG. 4, the lower ends 54L of torsion rods 50 will be restrained against rotation relative to the lower ends 131L of their associated gates 130. In this embodiment, lower end 131L of gate 130 is fitted with a cap member 70 having a square hole 72 for matingly receiving the square lower end 54L of a torsion rod 50, thus effectively locking torsion rod 50 against rotation relative to lower end 131L of gate 130. However, lower end 131L of gate 130 is unrestrained against rotation relative to housing 20. Accordingly, gates 130 and torsion rods 50 can be assembled in rotary drive system 110 such that sealing surfaces 137 associated with the outer edges 139 of gates 130 will initially be closely adjacent to or in contact with the surface of rotor 120. Optionally, torsion rods 50 may be installed with an initial pre-torque biasing gates 130 against rotor 120. Pivoting deflection of gates 130 caused by fluid flow through rotary drive system 110 will induce torsional strain (or increase any initial torsional strain) in torsion rods 50, thus positively biasing gates 130 toward rotor 120.

The number of rotor lobes 124 and the number of gates 130 can vary. Preferably, however, there will always be at least one fluid inlet port 116 and at least one fluid outlet port 117 located between adjacent rotor lobes 124 at any given time, and at least one gate 130 sealing between adjacent fluid inlet and outlet ports at any given time.

Torque and speed outputs of rotary drive system 110 are dependent on the length and radial height (i.e., gate lift) of chambers 140. For a given drive system length, a smaller gate lift produces higher rotational speed and lower torque. Conversely, a larger gate lift produces higher torque and lower rotational speed. In preferred embodiments, different configurations of gates 130 and rotor lobes 124, with varying levels of gate lift, can be used to achieve broad torque and speed ranges as may be required for different drilling applications, from low-speed/high-torque performance drilling to high-speed turbine applications.

Bearing assembly 100 comprises multiple bearings for transferring the various axial and radial loads between mandrel 10 and housing 20 that occur during the drilling process. Thrust bearings 102 and 103 transfer on-bottom and off-bottom operating loads, respectively, while radial bearing 104 and 105 transfers radial loads between mandrel 10 and housing 20. In preferred embodiments, the thrust bearings and radial bearings are mud-lubricated PDC (polycrystalline diamond compact) insert bearings, and a small portion of the drilling fluid is diverted through the bearings to provide lubrication and cooling. In other embodiments, other types of mud-lubricated bearings may be used, or one or more of the bearings may be oil-sealed.

In the embodiment shown in FIG. 2, radial loads are transferred from mandrel 10 to housing 20 through bearing 104, not from mandrel 10 to rotor 120. In alternative embodiments, however, radial loads could be transferred through rotor 120 if desired, by using rotor 120 itself as a radial bearing in lieu of radial bearing 104.

Figure 9:
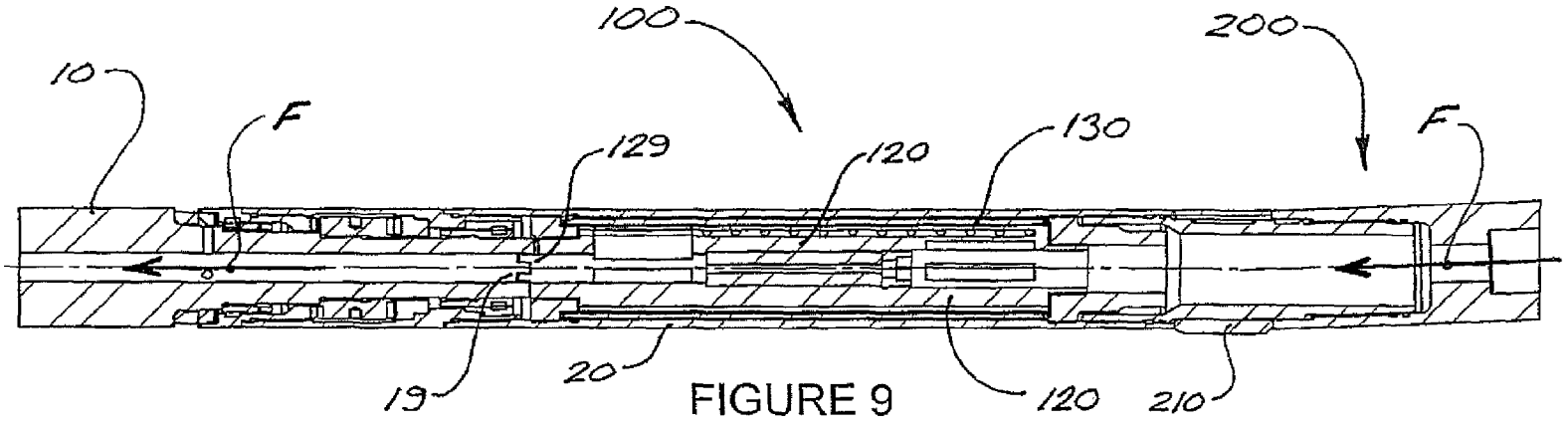
FIG. 9 is a longitudinal cross-section through a bearing assembly incorporating an alternative embodiment in which the rotor of the rotary drive system engages the mandrel of bearing section in end-to-end relation.
Figure 9A:
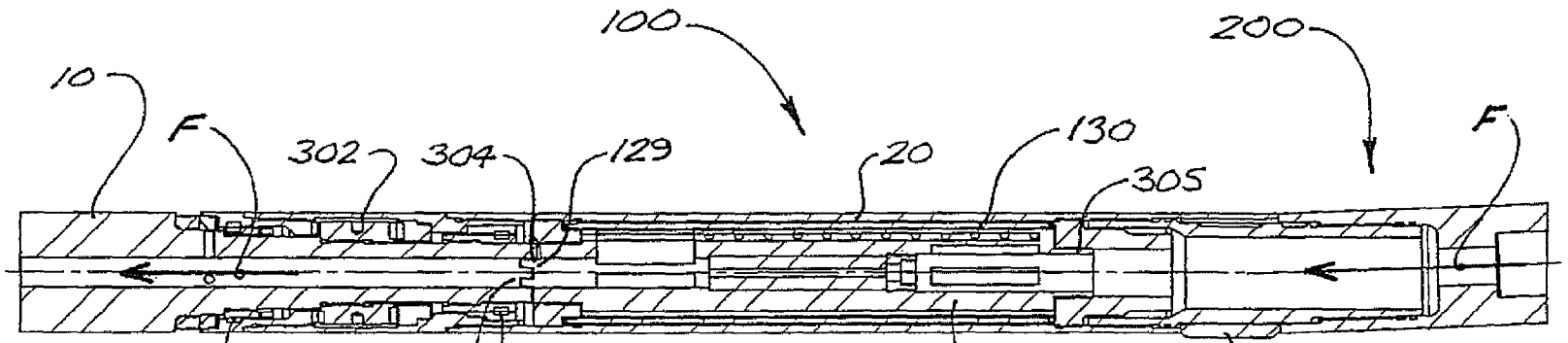
FIG. 9A is a longitudinal cross-section through a variant of the bearing assembly in FIG. 9.

In the alternative embodiment shown in FIG. 9A, the arrangement of the radial and axial bearings is changed such that radial loads are carried by mandrel 10 and preferably not transferred to rotor 120. In this embodiment, bearing assembly 100 section comprises a lower radial bearing 301 (analogous to radial bearing 105 in FIG. 2) and an additional radial bearing 303 below the rotary drive assembly, serving the same general function as radial bearing 104 in the embodiment shown in FIG. 2 but in a different location. Another set of bearings 304 and 305 may be used to locate rotor 120 both radially and axially.

In preferred embodiments, no elastomeric dynamic seals are used. Leakage is minimized by maintaining small amounts of clearance between components within drive system 110. Small amounts of leakage will reduce the overall efficiency of the drive system, but that is acceptable for this application. Efficiency will still equal or exceed that of a Moineau power section. Moreover, with no elastomeric dynamic seals being used, the motor will be suitable for high-temperature/geothermal applications that Moineau power sections cannot withstand.

Notwithstanding the foregoing discussion of thrust bearings and radial bearings in downhole motor bearing sections, it is to be noted that the particular types and arrangements of bearings that may be used in bearing assemblies incorporating rotary drive systems in accordance with the present disclosure are not directly relevant to such rotary drive systems, and do not form part of the broadest embodiments thereof.

FIGS. 2 and 3 illustrate optional additional features that are beneficial but not essential to rotary drive systems in accordance with the present disclosure. One such optional feature is a flow control mechanism in the form of a relief valve 150 which protects the assembly from excessive torque loads by limiting the amount of pressure that can build up within the rotary drive assembly. Relief valve 150 provides this protection by allowing fluid to bypass the rotary drive system when the fluid pressure exceeds a pre-set pressure, through a downstream bore 154 in relief valve 150 discharging into mandrel bore 14. The relief valve 150 illustrated in FIGS. 2 and 3 is only one non-limiting example of a device that may optionally be used to limit pressure build-up in rotary drive systems in accordance with the present disclosure.

Figure 10:
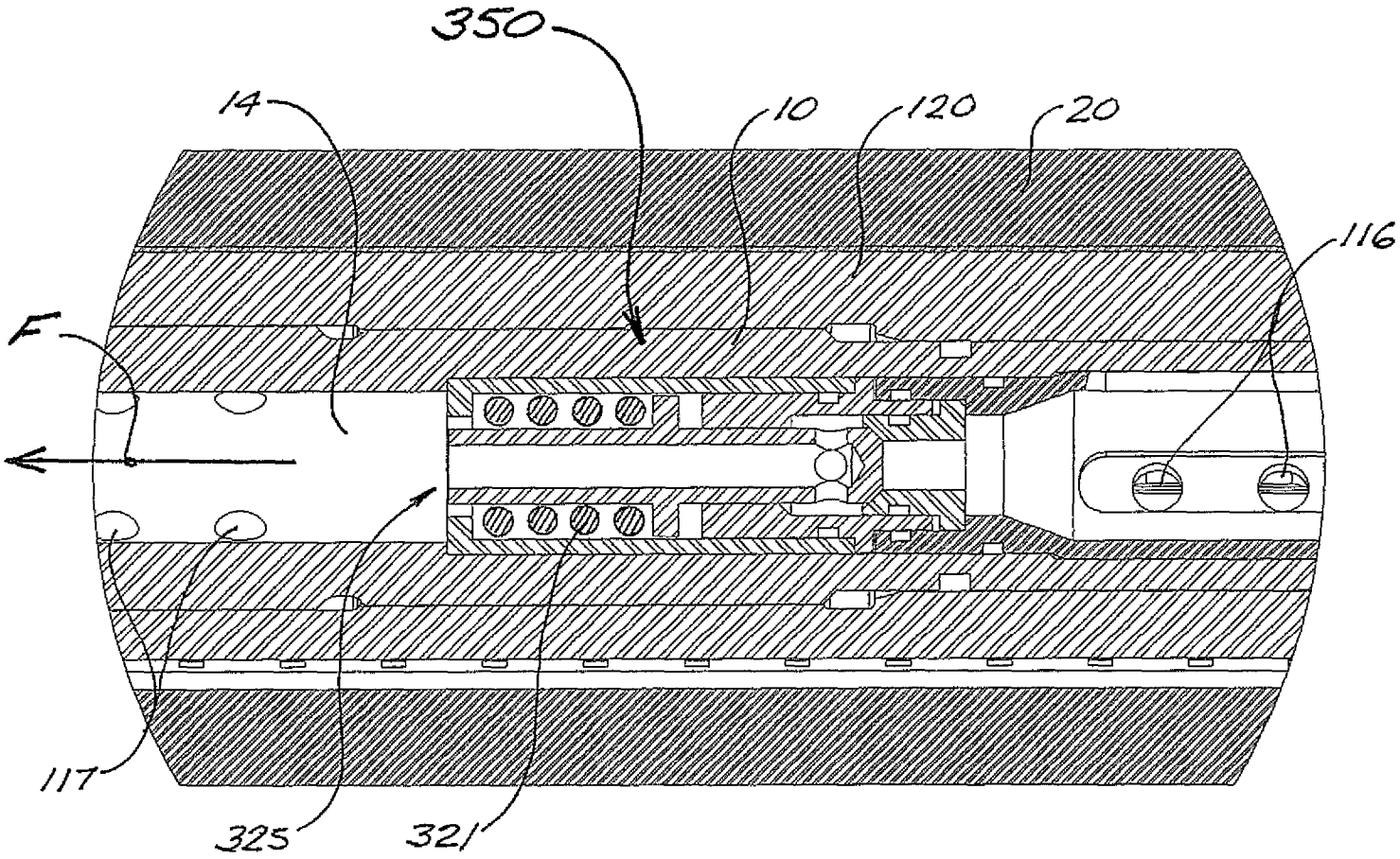
FIG. 10 is an enlarged sectional detail of one embodiment of a relief valve system for use in conjunction with rotary drive systems in accordance with the present disclosure.

FIG. 10 illustrates one embodiment of a mechanical relief valve system 350 which can be used to limit differential pressure across the rotary drive system by bypassing flow through rotor 120. This same mechanism could also be used as a speed control to limit RPM to a pre-set limit. Relief valve system 350 works such that fluid flow F enters the mechanism from right to left (as viewed with reference to FIG. 10), with relief valve system 350 sealing off flow so that it is forced through the rotary drive mechanism's fluid inlet and outlet ports and gates (as generally described previously herein). When the differential pressure across relief valve system 350 reaches a pre-set limit, a valve 325, biased by a spring 321, will move to the left allowing a portion of the flow to bypass the rotary drive system through the center of rotor 120. Valve 325 could alternatively be biased mechanically or hydraulically.

Figure 11:
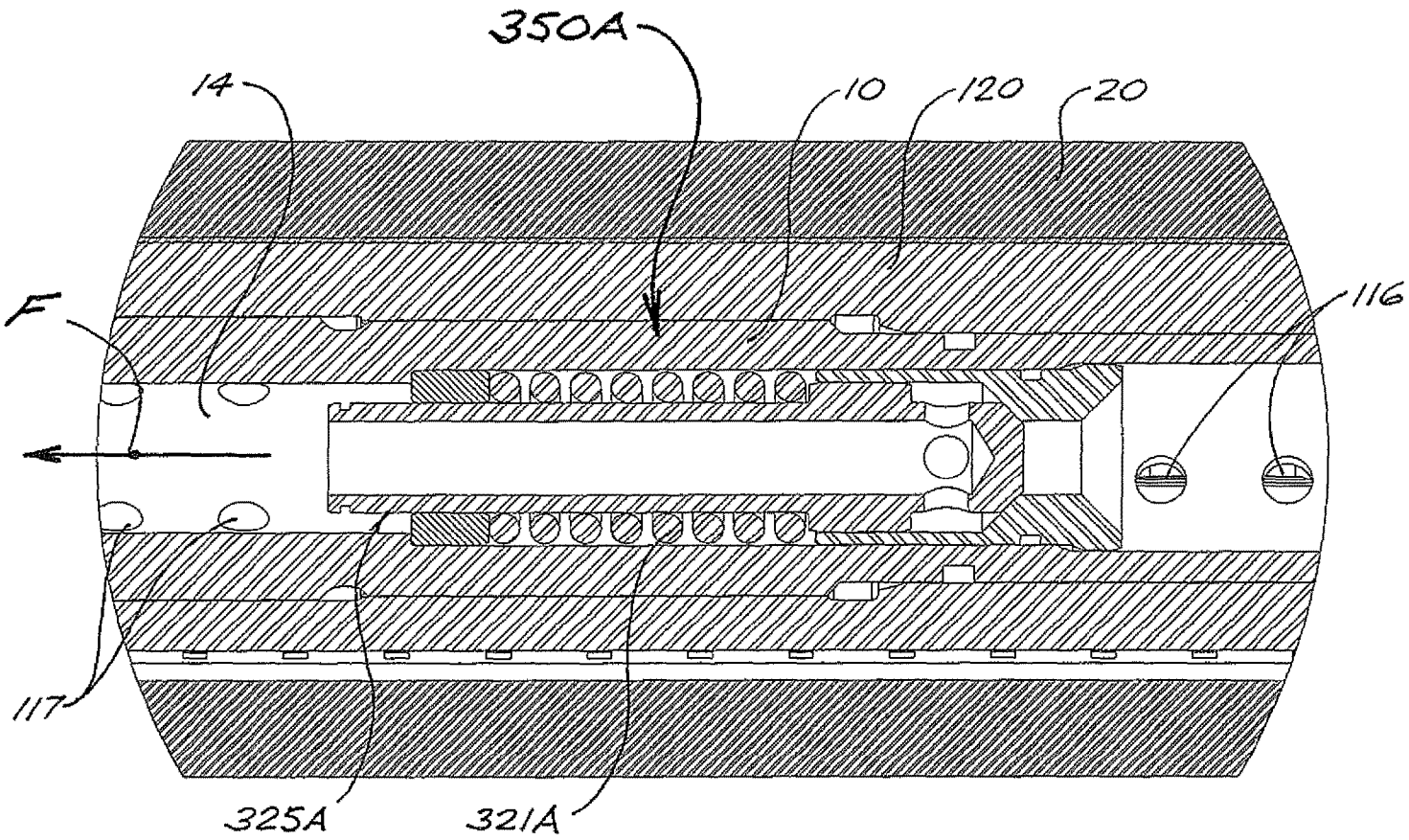
FIG. 11 is an enlarged sectional detail of a variant of the relief valve shown in FIG. 10.

FIG. 11 illustrates an alternative mechanical relief valve assembly 350A, which is operable in largely the same manner as described above with respect to relief valve system 350 shown in FIG. 10. Relief valve assembly 350A works such that flow fluid enters the device from right to left, with relief valve assembly 350A sealing off flow so that it is forced through the rotary drive mechanism's fluid inlet and exit ports and gates. When differential pressure reaches a pre-set limit, valve 325A, biased by a spring 321A, will move to the left allowing a portion of the flow to bypass the rotary drive system through the center of rotor 120. Valve 325A could alternatively be biased mechanically or hydraulically.

Alternatively, a mechanism similar to the two-speed motor disclosed in U.S. Pat. No. 7,523,792 (which is hereby incorporated by reference in its entirety) could also be used to allow an operator two different speed ranges at a given flow rate using the same rotary drive geometry. This would be accomplished by turning fluid flow on and off. Alternatively, this could be accomplished by an electronically-controlled valve system. This valve system could react to drilling conditions such as vibration, bit whirl, and stick slip, and/or it could be communicated with, either from surface or from a downhole signal generator, to change the amount of fluid bypass through rotor 120 in the rotary drive system.

Notwithstanding the preceding discussion, it is not essential to limit differential pressure across rotary drive systems in accordance with the present disclosure. Alternative embodiments may use other forms of flow control such as, by way of non-limiting example, a solid plate (either integral with either the mandrel or the rotor, or a separately-sealed component) to separate flow between the fluid inlet and outlet ports. Alternative embodiments may use a nozzle to continuously bypass a portion of the flow through the rotor in order to reduce the rotary speed of the drive section. Alternative embodiments may also use a burst disc to separate flow between inlet and outlet ports. In the event that the burst disc capacity is exceeded and the disc ruptures, all or a portion of the flow would subsequently bypass through the rotor. Alternative embodiments may incorporate a flow diverter as described in U.S. Pat. No. 6,976,832 to evenly distribute fluid intake and outlet flow along all or a portion of the length of the drive section.

Alternative embodiments may relieve pressure by bypassing drilling fluid directly to the annulus between housing 20 and the wellbore, or, alternatively, between bent housing 200 and the wellbore.

Another optional feature, illustrated in FIG. 2), is the use of sealing plates 160, which comprise mating wear-resistant surfaces that leak only a small amount of drilling fluid, so that nearly all of the fluid diverted to lubricate and cool the bearings is directed back through the mandrel and onward through the bit. Rotary seals could be used in place of sealing plates 160; alternatively, a flow restrictor of conventional type or diamond material (e.g., PDC) could be used.

In an alternative embodiment, the design could be changed to allow rotation of the stator section (housing 20 with gates 130) relative to rotor 120 and mandrel 10. This could be achieved, for example, by modifying the embodiments shown in FIGS. 1, 2, 9, and 9A. In such variant configurations, mandrel 10 would attach to the drill string, which would reverse the fluid flow path; i.e., whereas the fluid flow path F as shown in FIGS. 1, 2, and 9, is from right to left, the fluid flow path in the variant configurations would be from left to right, with the fluid inlet and outlet ports being suitably configured for this reversed fluid flow path. Having reference to FIGS. 2 and 9, this could necessitate design changes as follows:

- First, the bent sub could be moved to the left (i.e., lower) side of the mandrel.
- A suitable bit box sub would need to be added in place of the housing 200 to allow connection to the drill bit (alternatively, this connection could be a pin connection).
- The bypass valves would also need to be "flipped" to allow flow to bypass from left to right.

It will be readily apparent to those skilled in the art that driveshafts/clutches, additional stages in series or parallel, inlet and outlet ports, gate orientation, and bearings could be moved above or below the power section when holding the mandrel stationary and allowing the stator section (housing) to rotate.

Alternative embodiments may use rotary drive systems generally as disclosed in any of U.S. Pat. No. 6,280,169, U.S. Pat. No. 6,468,061, and U.S. Pat. No. 6,939,117, in combination with similar coupling means within the drilling motor, and similar arrangements of bearings. These systems utilize similar principles of operation, but with alternative forms of the gate/lobe system, such as radially-actuating gates as opposed to pivoting gates, or pivoting gates connected to the mandrel and engageable by lobes formed on the bearing section housing.

For example, referring to FIG. 3, housing 20, gates 130, and torsion rods 50 could be replaced with the necessary components from the system of radially-actuating gates illustrated in FIG. 33 in U.S. Pat. No. 6,280,169. As another example, referring again to FIG. 3, housing 20, gates 130, torsion rods 50, and rotor 120 could be replaced with the necessary components from the system illustrated in FIG. 9A in U.S. Pat. No. 6,939,117, wherein the lobes are fixed to the housing and the gates are mounted about the outer surface of the mandrel.

Having regard to the preceding discussion, it is to be appreciated that concentric rotary drive systems in accordance with the present disclosure are not limited to embodiments in which the gates are mounted to the housing (and deflectable into gate pockets formed in the housing) and in which gate-actuating lobes are incorporated into a mandrel concentrically rotatable within the housing. The present disclosure also extends to alternative embodiments having gates mounted to the mandrel (and deflectable into gate pockets formed in the mandrel) and in which gate-actuating lobes are incorporated into the housing, and also to embodiments incorporating radially-actuating gates.

Accordingly, one category of concentric rotary drive systems in accordance with the present disclosure can be broadly described as comprising:

- a first body and a second body, with a selected one of the bodies being coaxially disposed inside the other body to define a working fluid space therebetween, and with the second body being rotatable relative to the first body about a rotational axis;
- at least one gate pivotably supported by a selected one of the first and second bodies, and pivotable about a pivot axis parallel to the rotational axis; and
- at least one lobe provided on the body not supporting the at least one gate, with the at least one lobe being configured to contact the at least one gate during rotation of the second body.

Therefore, the component referenced previously in this Detailed Description as "housing 20" could, in alternative embodiments, be characterized as either the "first body" or the "second body", with the component referenced as rotor 120 being characterized as either the "second body" or the "first body". It will also be appreciated that in certain alternative embodiments the rotary drive system could be configured such that the selected body coaxially disposed within the other body could be non-rotating relative to the drill string; i.e., the other (or outer) body would be rotatable relative to the "selected" (i.e., inner) body. Persons skilled in the art will appreciate that such alternative embodiments can be put in to practice on the basis of the present disclosure, modified as a given embodiment may require having reference to the information provided herein and common general knowledge in the art, and without need for specific illustration, significant experimentation, or inventive input.

Figure 13:
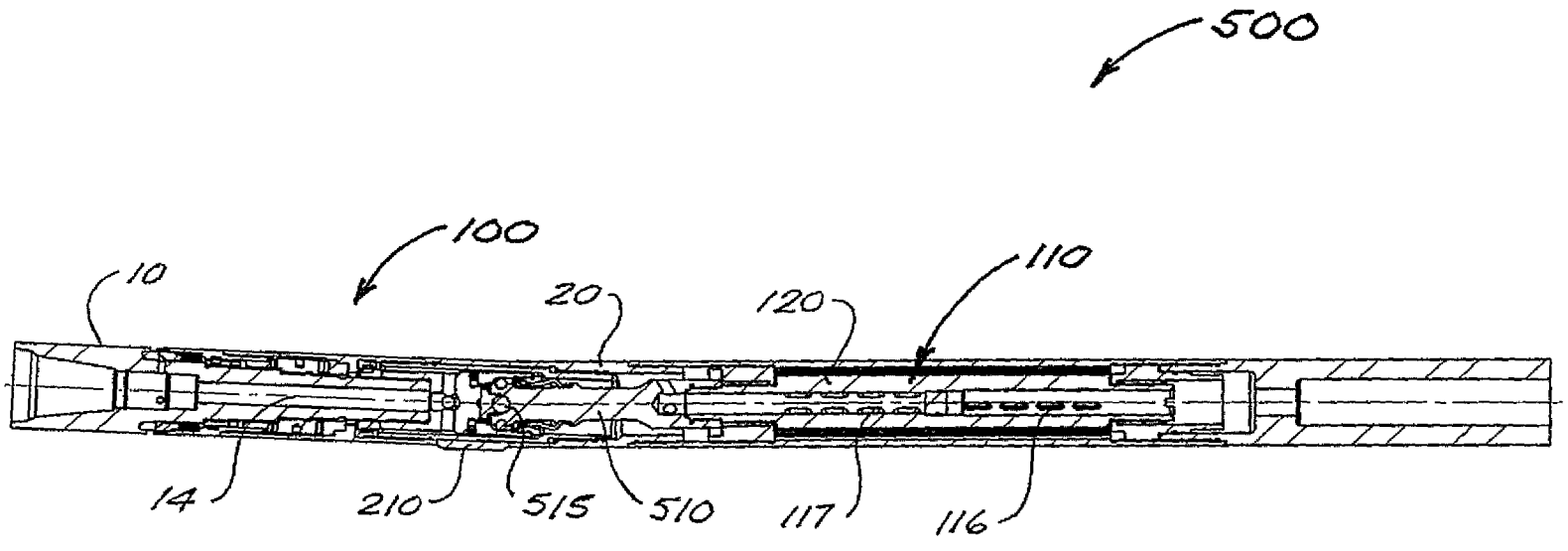
FIG. 13 is a longitudinal cross-section through an alternative embodiment of a downhole motor incorporating a concentric rotary drive system in accordance with the present disclosure, in which the bent housing is located below the rotary drive system and the rotary drive system is operatively connected to the motor's bearing section by a drive shaft having a single U-joint.
Figure 13A:
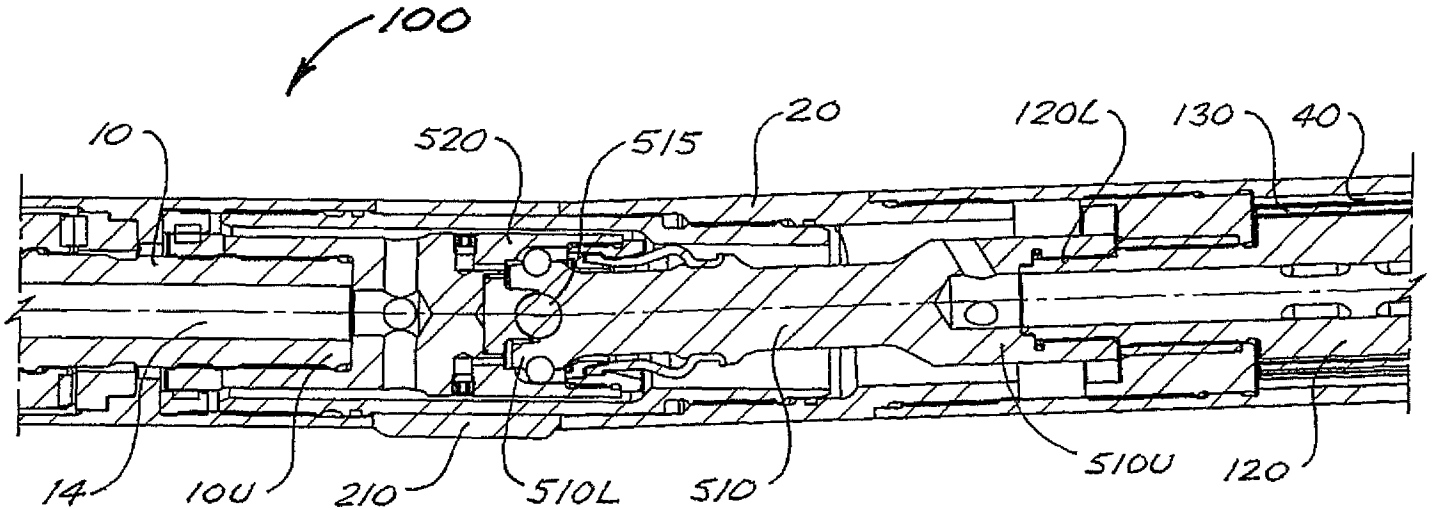
FIG. 13A is an enlarged cross-sectional view of the bent housing and drive shaft of the downhole motor in FIG. 13.

FIGS. 13 and 13A illustrate an alternative embodiment 500 of a downhole motor incorporating a concentric rotary drive system 110 in accordance with the present disclosure. In this variant embodiment, the bent sub 210 is located below rotary drive system 110, and rotary drive system 110 is operatively connected to the motor's bearing section 100 by a drive shaft 510. Because rotary drive system 110 does not operate eccentrically like a conventional downhole motor drive section, drive shaft 510 requires a universal joint (U joint) 515 only at its lower end 510L, where it engages a lower drive shaft housing 520 coupled to the upper end 10U of mandrel 10 of bearing section 100, adjacent to bent sub 210. At its upper end 510U, drive shaft 510 is connected rigidly and coaxially to the lower end 120L of rotor 120, by any functionally suitable means.

Figure 14:
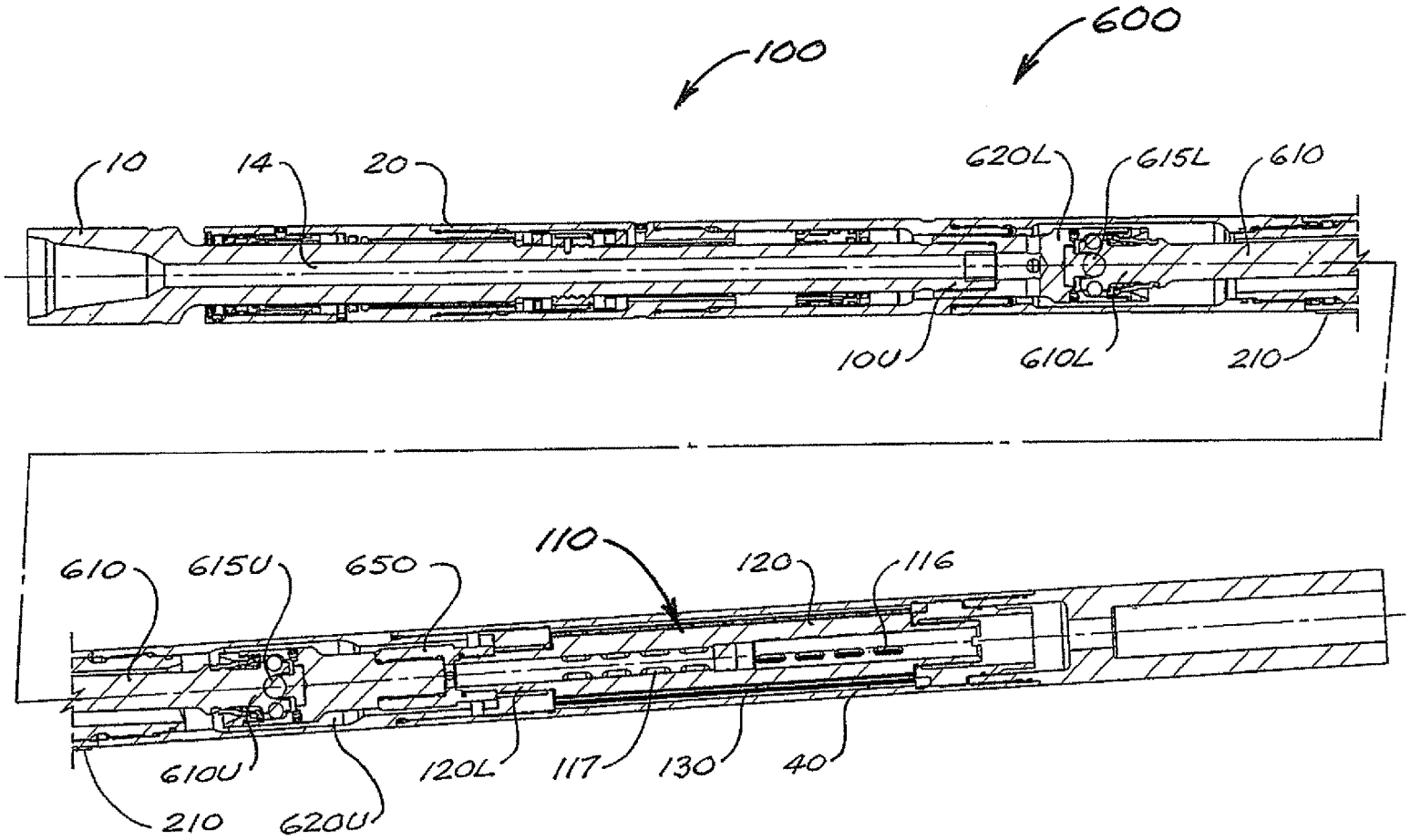
FIG. 14 is a longitudinal cross-section through a further embodiment of a downhole motor incorporating a concentric rotary drive system in accordance with the present disclosure, in which the rotary drive system is connected to a conventional bearing section by means of a conventional drive shaft having two U-joints.

FIG. 14 illustrates a further alternative embodiment 600 of a downhole motor incorporating a concentric rotary drive system in accordance with the present disclosure. In this embodiment, rotary drive system 110 is connected to a conventional bearing section 100 by means of a conventional drive shaft 610 having upper and lower U-joints 615U and 615L at its upper and lower ends 610U and 610L. Lower U-joint 615L engages a lower drive shaft housing 620L coupled to the upper end 10U of mandrel 10, similar to the embodiment shown in FIGS. 13 and 13A. In this embodiment, bent sub 210 is located approximately midway between U-joints 615U and 615L.

Upper U-joint 615U engages an upper drive shaft housing 620U which in turn is connected rigidly and coaxially to lower end 120L of rotor 120. In the specific embodiment shown in FIG. 14, upper drive shaft housing 620U connects to rotor 120 by means of a threaded and splined coupling 650 generally similar to coupling 410 shown in FIGS. 12, 12A, and 12B. However, this is by way of non-limiting example only, and the connection between upper drive shaft housing 620U and rotor 120 could alternatively be effected by any functionally suitable means.

The embodiments of rotary drive system 110 illustrated in the Figures may be referred to as a single-stage drive system; i.e., having a single set of gates 130 associated with a lobed rotor 120. However, alternative embodiments of rotary drive system 110 may incorporate multiple-stage drives as necessary or desirable to achieve required performance.

For embodiments having multiple power sections aligned in series, the power sections can be coupled by means of a splined and/or threaded connection, such as, for example, the connection illustrated in FIGS. 12, 12A, and 12B. Alternatively the power sections could be coupled by means of an arrangement as in the exemplary embodiment in FIG. 9, with component 129 being used on the right end of the rotor to connect to another power section of similar type, or to connect a power section as disclosed herein to a conventional Moineau or turbine-type drive system. This arrangement could also use a driveshaft between the rotary drive system and a Moineau or turbine drive system. This arrangement would allow for increased torque output, but with higher differential pressure than using just one power section.

In further alternative embodiments, a gear box could be incorporated into the coupling between two power sections coupled in series.

For embodiments having multiple power sections arranged to be run in parallel, two power sections as disclosed herein could be run end to end and coupled by means of splined, threaded, or clutch-type engagement as stated above. A flow diverter would be needed to send a portion of the flow past the first stage to the second stage only and then on to the bit. This flow diverter would allow flow to enter either the first stage or the second stage only, and then exit to the bit without entering the other stage. This arrangement would allow increased torque output at the same differential pressure across the rotary drive system.

It will be readily appreciated by those skilled in the art that various modifications to embodiments in accordance with the present disclosure may be devised without departing from the scope and teaching of the present teachings, including modifications which may use equivalent structures or materials hereafter conceived or developed. It is to be especially understood that the scope of the present disclosure is not intended to be limited to described or illustrated embodiments, and that the substitution of a variant of a claimed element or feature, without any substantial resultant change in functionality, will not constitute a departure from the scope of the disclosure. It is also to be appreciated that the different teachings of the embodiments described and discussed herein may be employed separately or in any suitable combination to produce desired results.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element.

Any use of any form of the terms "connect", "engage", "couple", "attach", or any other term describing an interaction between elements is not meant to limit the interaction to direct interaction between the subject elements, and may also include indirect interaction between the elements such as through secondary or intermediary structure.

Relational terms such as "parallel", "concentric", and "coaxial" are not intended to denote or require absolute mathematical or geometrical precision. Accordingly, such terms are to be understood as denoting or requiring substantial precision only (e.g., "substantially parallel") unless the context clearly requires otherwise.

Wherever used in this document, the terms "typical" and "typically" are to be interpreted in the sense of representative of common usage or practice, and are not to be interpreted as implying essentiality or invariability.

The invention claimed is:

1. A rotary fluid drive system comprising:

a first body and a second body, with a selected one of the bodies being coaxially disposed inside the other body to define a working fluid space therebetween, and with the second body being rotatable relative to the first body about a rotational axis;

a plurality of gates supported by the first body, wherein each of the gates is configured to swing or pivot about a pivot axis oriented parallel to the rotational axis;

a plurality of torsion rods, wherein each of the torsion rods extends through a longitudinal pin bore provided in one of the gates and has a longitudinal axis aligned with the pivot axis of the corresponding gate, wherein each of the torsion rods is configured to bias and swing the corresponding gate about the corresponding pivot axis toward the second body;

at least one lobe provided on the second body;

one or more fluid inlet ports directing fluid flow into the working fluid space; and one or more fluid outlet ports axially spaced from the fluid inlet ports and directing fluid flow out of the working fluid space;

wherein:

for each of the gates, the first body defines a gate pocket into which the associated gate can swing when contacted by the at least one lobe;

the rotary fluid drive system defines a fluid path through which a working fluid can enter and exit the drive system, wherein the fluid path includes the one or more fluid inlet ports, the working fluid space, and the one or more fluid outlet ports, such that a flow of a working fluid along the fluid path will cause rotation of the second body relative to the first body.

2. The rotary fluid drive system according to claim 1 wherein each of the gates and associated gate pocket are configured to form at least one gate pocket flow path through which fluid can flow from between the gate pocket and the gate into the working fluid space when the gate is swung to a maximum extent into the gate pocket.

3. The rotary fluid drive system according to claim 2 wherein each gate has a free longitudinal edge and each of the gates and corresponding gate pocket are configured so that when the gate is swung to the maximum extent into its associated gate pocket the longitudinal edge faces and is spaced from a wall of the gate pocket to create a downstream portion of the gate pocket flow path.

4. The rotary fluid drive system according to claim 2 wherein each of the gates includes a surface facing its corresponding gate pocket, wherein the surface of each of the gates comprises a plurality of projections, wherein a gap is provided between respective mutually adjacent projections, each of the gags creating an associated upstream portion of the gate pocket flow path.

5. The rotary fluid drive system according to claim 4 wherein the projections and the gate pockets are configured such that the projections can abut a surface of the gate pocket when the gate is swung to the maximum extent into its associated gate pocket.

6. The rotary fluid drive system according to claim 4 wherein the projections are evenly spaced along a length of a respective gate.

7. The rotary fluid drive system according to claim 4 wherein the gaps between the projections are sized such that the cumulative lengths of the gaps on each of the gates correspond to at least 10% of the length of the gate.

8. The rotary fluid drive system according to claim 4 wherein the gaps between the projections are sized such that the cumulative lengths of the gaps on each of the gates correspond to at least 30% of the length of the gate.

9. The rotary fluid drive system according to claim 4 wherein the gaps between the projections are sized such that the cumulative lengths of the gaps on each of the gates correspond to up to 90% of the length of the gate.

10. The rotary fluid drive system according to claim 1 wherein each of the gate pockets and associated gate are configured to form a debris chamber therebetween, wherein the debris chamber is configured to accommodate debris when the associated gate is disposed in the corresponding gate pocket;

wherein each of the debris chambers is formed in the first body.

11. The rotary fluid drive system according to claim 1 wherein a first end of each of the torsion rods is held rotationally fixed relative to the associated gate.

12. The rotary fluid drive system according to claim 11 wherein the first end of each of the torsion rods is keyed into a portion of the second body.

13. The rotary fluid drive system according to claim 1 wherein the one or more fluid inlet ports are located upstream of the one or more fluid outlet ports with reference to a direction of flow of the working fluid along the fluid path.

14. The rotary fluid drive system according to claim 13 comprising a flow control mechanism disposed in the second body between the one or more inlet ports and the one or more outlet ports.

15. The rotary fluid drive system according to claim 1 wherein the second body is disposed inside of the first body.

16. The rotary fluid drive system of claim 1 wherein each of the gate pockets and associated gate are configured to form a debris chamber therebetween, wherein the debris chamber is configured to accommodate debris when the associated gate is disposed in the corresponding gate pocket.

17. The rotary fluid drive system of claim 16, wherein each of the gates and associated gate pocket are configured to form at least one gate pocket flow path through which fluid can flow from between the gate pocket and the gate into the working fluid space when the gate is swung to a maximum extent into the gate pocket, wherein each of the debris chambers is in fluid communication with the corresponding gate pocket flow path when the corresponding gate is swung to the maximum extend into the gate pocket.

18. The rotary fluid drive system of claim 1, wherein each of the gates has a longitudinal pivot side pivotally mounted to the first body and a free longitudinal edge opposite the longitudinal pivot side, wherein each of the gates is configured to pivot about the longitudinal pivot side;

wherein each of the longitudinal pin bores extends through the longitudinal pivot side of the corresponding gate.

19. The rotary fluid drive system of claim 1, wherein each of the gates extends around the entire outer perimeter of the corresponding torsion rod.

20. The rotary fluid drive system of claim 1, wherein each of the gates has an upper end and a lower end opposite the upper end;

wherein the longitudinal pin bore of each of the gates extends from the upper end to the lower end of the corresponding gate;

wherein each torsion rod extends through the longitudinal pin bore of the corresponding gate from the upper end to the lower end of the corresponding gate.

21. A rotary fluid drive system comprising:

a first body and a second body, with the bodies being coaxially disposed one inside the other body to define a working fluid space there between, and with the second body being rotatable relative to the first body about a rotational axis;

at least one gate supported by the first body, such that each of the gates can swing or pivot about an axis parallel to the rotational axis;

at least one lobe provided on the second body;

one or more fluid inlet ports directing a flow of a working fluid into the working fluid space; and one or more fluid outlet ports axially spaced from the fluid inlet ports and directing the flow of the working fluid out of the working fluid space; wherein:

for each of the gates, the first body defines a gate pocket into which the associated gate can swing when contacted by the at least one lobe;

each of the gates has a surface facing the associated gate pocket, wherein the surface includes plurality of projections, with gaps between adjacent projections defining a gate pocket flow path;

the rotary fluid drive system defines a fluid path through which the working fluid can enter and exit the drive system, wherein the fluid path includes the one or more fluid inlet ports, the working fluid space, and the one or more fluid outlet ports, such that the flow of the working fluid along the fluid path will cause rotation of the second body relative to the first body; and wherein the working fluid can flow via each of the gate pocket flow path from the associated gate pocket into the working fluid space when the associated gate is maximally deflected into its associated gate pocket.

22. The rotary fluid drive system according to claim 21 wherein each of the gates has a free longitudinal edge and each of the gates and its associated gate pocket are configured so that when the gate has swung to the maximum extent into its associated gate pocket the longitudinal edge will face and be spaced from a wall of the gate pocket to create a downstream portion of the gate pocket flow path.

23. The rotary fluid drive system according to claim 21 wherein the projections are evenly spaced along a length of a respective gate.

24. The rotary fluid drive system according to claim 21 wherein the gaps between the projections are sized such that the cumulative lengths of the gaps on each gate correspond to at least 10% of the length of the gate.

25. The rotary fluid drive system according to claim 21 wherein the gaps between the projections are sized such that the cumulative lengths of the gaps on each gate correspond to at least 30% of the length of the gate.

26. The rotary fluid drive system according to claim 21 wherein the gaps between the projections are sized such that the cumulative lengths of the gaps on each gate correspond to up to 90% of the length of the gate.

27. The rotary fluid drive system according to claim 21 wherein each of the gates is provided with an associated biasing means arranged to swing the gate in a direction away from its associated gate pocket and toward the body provided with the at least one lobe.

28. The rotary fluid drive system according to claim 27 wherein the biasing means extends along and within a longitudinal bore formed in the associated gate.

29. The rotary fluid drive system according to claim 27 wherein one end of the biasing means is held rotationally fixed relative to the associated gate.

30. The rotary fluid drive system according to claim 29 wherein the one end of the biasing means is keyed into a portion of the body provided with the gate pockets.

31. The rotary fluid drive system according claim 21 comprising a flow control mechanism disposed in the second body between the one or more fluid inlet ports and the one or more outlet ports.

* * * * *